US011554582B2

(12) United States Patent
Kobayashi et al.

(10) Patent No.: US 11,554,582 B2
(45) Date of Patent: Jan. 17, 2023

(54) LIQUID DISCHARGING APPARATUS, LIQUID DISCHARGING SYSTEM, PATTERN RECORDING METHOD, AND COMPUTER-READABLE STORAGE MEDIUM

(71) Applicant: BROTHER KOGYO KABUSHIKI KAISHA, Nagoya (JP)

(72) Inventors: Isao Kobayashi, Nagoya (JP); Takahiro Miyao, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/365,133

(22) Filed: Jul. 1, 2021

(65) Prior Publication Data

US 2022/0009225 A1 Jan. 13, 2022

(30) Foreign Application Priority Data

Jul. 8, 2020 (JP) ..... JP2020-117968

(51) Int. Cl.

*B41J 2/045* (2006.01)
*B41J 25/00* (2006.01)
*B41J 2/145* (2006.01)

(52) U.S. Cl.

CPC ..... *B41J 2/04508* (2013.01); *B41J 2/04586* (2013.01); *B41J 2/145* (2013.01); *B41J 25/006* (2013.01)

(58) Field of Classification Search

CPC .... B41J 2/04508; B41J 2/04586; B41J 2/145; B41J 25/006

See application file for complete search history.

(56) References Cited

U.S. PATENT DOCUMENTS 9,579,894 B2 * 2/2017 Yokota ..... B41J 15/046
2011/0001778 A1 1/2011 Kanda et al.
2018/0072081 A1 3/2018 Kimura et al.

FOREIGN PATENT DOCUMENTS

JP 2006-27282 A 2/2006
JP 2011-11464 A 1/2011
JP 2018-39232 A 3/2018

* cited by examiner

*Primary Examiner* — Thinh H Nguyen
(74) *Attorney, Agent, or Firm* — Scully, Scott, Murphy & Presser, PC

(57) ABSTRACT

A liquid discharging apparatus, having a liquid discharging head, a relatively-movable device, and a controller, is provided. The controller controls the liquid discharging head and the relatively-movable device to record a plurality of relative movement adjuster patterns, arranged at different positions in an arrayed direction, and a different pattern, arranged side by side with the plurality of relative movement adjuster patterns along a direction orthogonal to an arrayed direction on a same liquid-discharge objective medium. The controller controls the relatively-movable device, after recording at least one of the plurality of relative movement adjuster patterns, and before recording a next one of the plurality of relative movement adjuster patterns next to the at least one of the plurality of relative movement adjuster patterns, to perform a relative moving action by a moving amount different from a predetermined relative moving amount for recording the different pattern at least once.

12 Claims, 17 Drawing Sheets

LIQUID DISCHARGING APPARATUS, LIQUID DISCHARGING SYSTEM, PATTERN RECORDING METHOD, AND COMPUTER-READABLE STORAGE MEDIUM

CROSS REFERENCE TO RELATED APPLICATION

This application claims priority under 35 U.S.C. § 119 from Japanese Patent Application No. 2020-117968, filed on Jul. 8, 2020, the entire subject matter of which is incorporated herein by reference.

BACKGROUND

Technical Field

An aspect of the present disclosure is related to a liquid discharging apparatus capable of discharging liquid through nozzles, a liquid discharging system having the liquid discharging apparatus, a pattern recording method for recording patterns with the liquid discharging apparatus, and a computer-readable storage medium for storing computer-readable instructions to cause the liquid discharging apparatus to record the patterns.

Related Art

A liquid discharging apparatus, e.g., a printer, configured to discharge liquid through nozzles at a recordable sheet to record patterns, is known. The printer may record, for example, a conveying-amount adjuster pattern, by which amounts to convey the recordable sheet with a conveyer roller may be adjusted, and a discharging-timing adjuster pattern, by which discharging timings to discharge ink through the nozzles may be adjusted.

For recording the conveying-amount adjuster pattern, first, scan-printing to print a plurality of first parts aligning in a row along a scanning direction may be conducted; thereafter, second, the conveyer roller may be driven to convey the recordable sheet by a predetermined amount, and the scan-printing may be conducted to print a plurality of second parts aligning in a row along the scanning direction in an arrangement such that each of the second parts is located at a same position in the scanning direction with one of the plurality of second parts.

Meanwhile, for recording the discharging-timing adjuster pattern, first, scan-printing to print the plurality of first parts while a carriage is moved in one way, e.g., rightward, may be conducted, and second, scan-printing to print the plurality of second parts while the carriage is moved the other way, e.g., leftward, may be conducted. Thereafter, the conveyer roller may be driven to convey the recordable medium, and the first parts and the second parts may be alternately printed repetitively.

SUMMARY

For these pattern-recording operations, the conveying-amount adjuster pattern and the discharging-timing adjuster pattern may be recorded on different recordable sheets. In other words, two or more recordable sheets may be required for recording the different patterns. In this regard, it may be considered to record the conveying-amount adjuster pattern and the discharging-timing adjuster pattern on a same recordable sheet to reduce the number of recordable sheets to be used for printing the patterns.

For example, the conveying-amount adjuster pattern and the discharging-timing adjuster pattern may be recorded side-by-side along the scanning direction. However, the operations to record the conveying-amount adjuster pattern and the discharging-timing adjuster pattern each include conveying actions to convey the recordable sheet intermittently at different timings. Moreover, conveying amounts to convey the recordable sheet in the recording operation to record the conveying-amount adjuster pattern and conveying amounts to convey the recordable sheet in the recording operation to record the discharging-timing adjuster pattern may be different. Therefore, in order to record the conveying-amount adjuster pattern and the discharging-timing adjuster pattern side-by-side along the scanning direction, some modification or arrangement may be necessary.

An aspect of the present disclosure is advantageous in that a liquid discharging apparatus and a liquid discharging system capable of recording a plurality of patterns, by which relative moving amounts between a liquid discharging head and a liquid-discharge objective medium may be adjusted, and a different pattern, which requires relative movement between the liquid discharging head and the liquid-discharge objective medium when being recorded, on a same liquid-discharge objective medium, are provided; and in that a method for recording the patterns and a computer-readable storage medium for storing computer-readable instructions for recording the patterns are provided.

According to an aspect of the present disclosure, a liquid discharging apparatus, having a liquid discharging head, a relatively-movable device, and a controller, is provided. The liquid discharging head has a plurality of nozzles arrayed in an arrayed direction and is configured to perform a discharging action to discharge liquid from at least a part of the plurality of nozzles. The relatively-movable device is configured to perform a relative moving action to move the liquid discharging head and a liquid-discharge objective medium relatively in the arrayed direction. The controller is configured to control the liquid discharging head and the relatively-movable device to record a relative movement adjuster pattern, having a first pattern piece and a second pattern piece, and a different pattern, having a plurality of different-pattern pieces. The relative movement adjuster pattern and the different pattern are arranged side by side along a direction orthogonal to the arrayed direction on a same liquid-discharge objective medium. The controller is configured to control the liquid discharging head and the relatively-movable device to record the relative movement adjuster pattern by controlling the liquid discharging head to perform the discharging action to record the first pattern piece; after the discharging action to record the first pattern piece, controlling the relatively-movable device to perform the relative moving action to move the liquid discharging head and the liquid-discharge objective medium relatively by a predetermined relative moving amount at least once; and after the relative moving action by the predetermined relative moving amount, controlling the liquid discharging head to perform the discharging action to record the second pattern piece. The controller is configured to control the liquid discharging head and the relatively-movable device to record the different pattern by controlling the liquid discharging head to perform the discharging action for a plurality of times and controlling the relatively-movable device to perform the relative moving action to move the liquid discharging head and the liquid-discharge objective medium relatively by a moving amount different from the predetermined relative moving amount at least once. The relative movement adjuster pattern includes a plurality of relative movement adjuster patterns arranged at different positions in the arrayed direction. The plurality of relative movement adjuster patterns are recorded on the same liquid-discharge objective medium as the different pattern side by side along the direction orthogonal to the arrayed direction by the controller controlling the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

According to another aspect of the present disclosure, a liquid discharging system, having a liquid discharging apparatus and a controller connected with the liquid discharging apparatus, is provided. The liquid discharging apparatus has a liquid discharging head and a relatively-movable device. The liquid discharging head has a plurality of nozzles arrayed in an arrayed direction and is configured to perform a discharging action to discharge liquid from at least a part of the plurality of nozzles. The relatively-movable device is configured to perform a relative moving action to move the liquid discharging head and a liquid-discharge objective medium relatively in the arrayed direction. The controller being configured to control the liquid discharging head and the relatively-movable device to record a relative movement adjuster pattern, having a first pattern piece and a second pattern piece, and a different pattern, having a plurality of different-pattern pieces. The relative movement adjuster pattern and the different pattern are arranged side by side along a direction orthogonal to the arrayed direction on a same liquid-discharge objective medium. The controller is configured to control the liquid discharging head and the relatively-movable device to record the relative movement adjuster pattern by controlling the liquid discharging head to perform the discharging action to record the first pattern piece; after the discharging action to record the first pattern piece, controlling the relatively-movable device to perform the relative moving action to move the liquid discharging head and the liquid-discharge objective medium relatively by a predetermined relative moving amount at least once; and after the relative moving action by the predetermined relative moving amount, controlling the liquid discharging head to perform the discharging action to record the second pattern piece. The controller is configured to control the liquid discharging head and the relatively-movable device to record the different pattern by controlling the liquid discharging head to perform the discharging action for a plurality of times and controlling the relatively-movable device to perform the relative moving action to move the liquid discharging head and the liquid-discharge objective medium relatively by a moving amount different from the predetermined relative moving amount at least once. The relative movement adjuster pattern includes a plurality of relative movement adjuster patterns arranged at different positions in the arrayed direction. The plurality of relative movement adjuster patterns are recorded on the same liquid-discharge objective medium as the different pattern side by side along the direction orthogonal to the arrayed direction by the controller controlling the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

According to another aspect of the present disclosure, a pattern recording method for a liquid discharging apparatus, having a liquid discharging head including a plurality of nozzles arrayed in an arrayed direction, the liquid discharging head being configured to perform a discharging action to discharge liquid from at least a part of the plurality of nozzles, and a relatively-movable device configured to perform a relative moving action to move the liquid discharging head and the liquid-discharge objective medium relatively in the arrayed direction, to record patterns in liquid on a liquid-discharge objective medium, is provided. The method includes controlling the liquid discharging head and the relatively-movable device to record a relative movement adjuster pattern, having a first pattern piece and a second pattern piece, and a different pattern, having a plurality of different-pattern pieces. The relative movement adjuster pattern and the different pattern are arranged side by side along a direction orthogonal to the arrayed direction on a same liquid-discharge objective medium. The liquid discharging head and the relatively-movable device are controlled to record the relative movement adjuster pattern by performing the discharging action to record the first pattern piece; after the discharging action to record the first pattern piece, performing the relative moving action to move the liquid discharging head and the liquid-discharge objective medium relatively by a predetermined relative moving amount at least once; and after the relative moving action, performing the discharging action to record the second pattern piece. The liquid discharging head and the relatively-movable device are controlled to record the different pattern by performing the discharging action for a plurality of times and performing the relative moving action to move the liquid discharging head and the liquid-discharge objective medium relatively by a moving amount different from the predetermined relative moving amount at least once. The relative movement adjuster pattern includes a plurality of relative movement adjuster patterns arranged at different positions in the arrayed direction. The method further includes, for recording the plurality of relative movement adjuster patterns on the same liquid-discharge objective medium as the different pattern side by side along the direction orthogonal to the arrayed direction, controlling the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

According to another aspect of the present disclosure, a non-transitory computer readable storage medium storing computer readable instructions that are executable by a computer configured to control a liquid discharging apparatus, is provided. The liquid discharging apparatus has a liquid discharging head including a plurality of nozzles arrayed in an arrayed direction, the liquid discharging head being configured to perform a discharging action to discharge liquid from at least a part of the plurality of nozzles, and a relatively-movable device configured to perform a relative moving action to move the liquid discharging head and the liquid-discharge objective medium relatively in the arrayed direction. The computer readable instructions, when executed by the computer, causing the computer to control the liquid discharging head and the relatively-movable device to record a relative movement adjuster pattern, having a first pattern piece and a second pattern piece, and a different pattern, having a plurality of different-pattern pieces. The relative movement adjuster pattern and the different pattern are arranged side by side along a direction orthogonal to the arrayed direction on a same liquid-discharge objective medium. The computer readable instructions causing the computer to control the liquid discharging head and the relatively-movable device to record the relative movement adjuster pattern by controlling the liquid discharging head to perform the discharging action to record the first pattern piece; after the discharging action to record the first pattern piece, controlling the relatively-movable device to perform the relative moving action to move the liquid discharging head and the liquid-discharge objective medium relatively by a predetermined relative moving amount at least once; and after the relative moving action by the predetermined relative moving amount, controlling the liquid discharging head to perform the discharging action to record the second pattern piece. The computer readable instructions causing the computer to control the liquid discharging head and the relatively-movable device to record the different pattern by controlling the liquid discharging head to perform the discharging action for a plurality of times and controlling the relatively-movable device to perform the relative moving action to move the liquid discharging head and the liquid-discharge objective medium relatively by a moving amount different from the predetermined relative moving amount at least once. The relative movement adjuster pattern includes a plurality of relative movement adjuster patterns arranged at different positions in the arrayed direction. The computer readable instructions, when executed by the computer, for recording the plurality of relative movement adjuster patterns on the same liquid-discharge objective medium as the different pattern side by side along the direction orthogonal to the arrayed direction, cause the computer to control the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

BRIEF DESCRIPTION OF THE ACCOMPANYING DRAWINGS

Figure 7C:
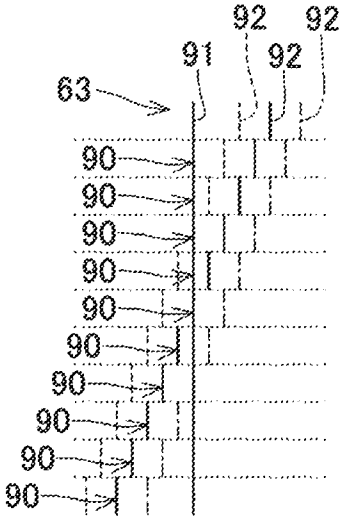
Figure 7C:
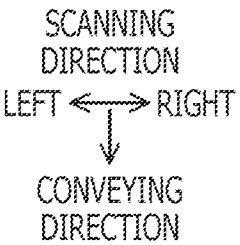
Figure 7B:
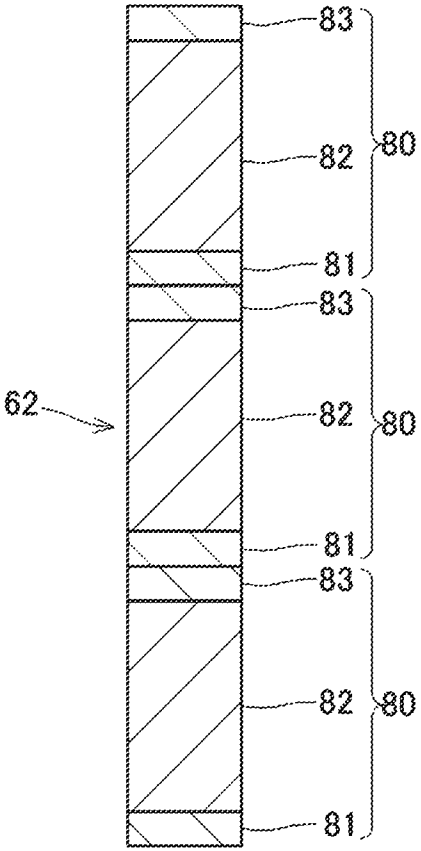
Figure 7A:
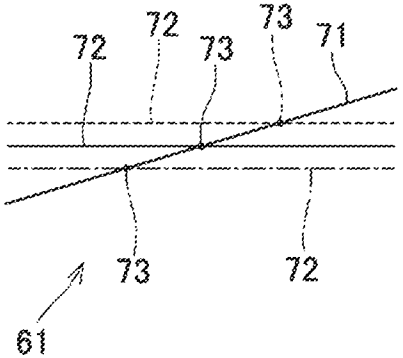

FIG. 7A illustrates an enlarged view of a conveyance adjuster pattern recordable in the inkjet printer according to the embodiment of the present disclosure. FIG. 7B illustrates an enlarged view of an evenness adjuster pattern recordable in the inkjet printer according to the embodiment of the present disclosure. FIG. 7C illustrates an enlarged view of a timing adjuster pattern recordable in the inkjet printer according to the embodiment of the present disclosure.

Figure 8A:
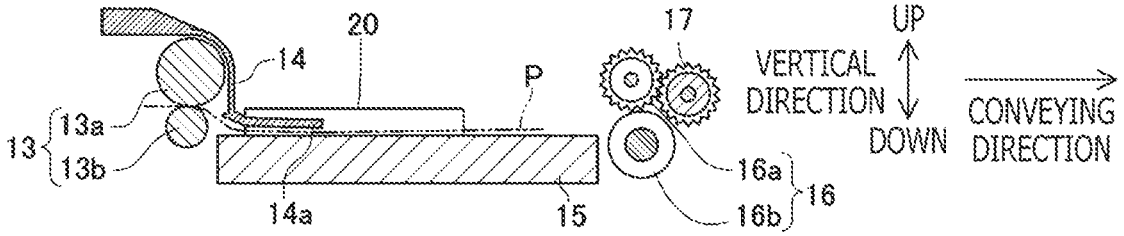
Figure 8B:
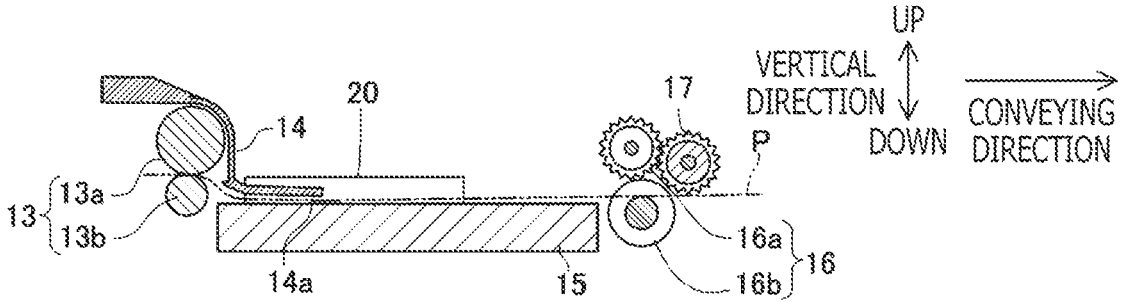
Figure 8C:
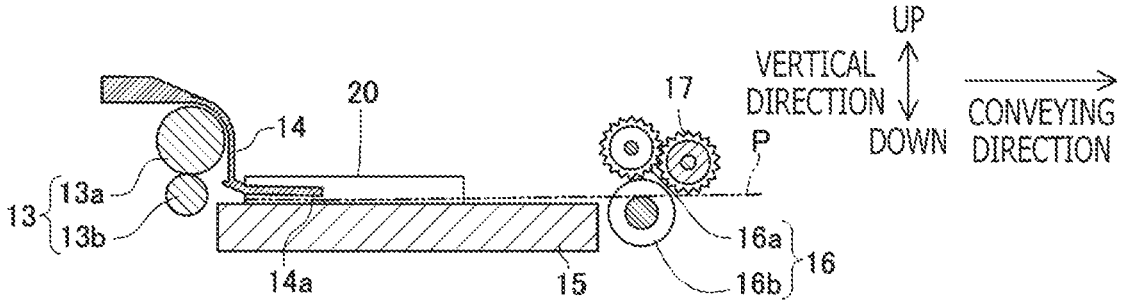
Figure 8D:
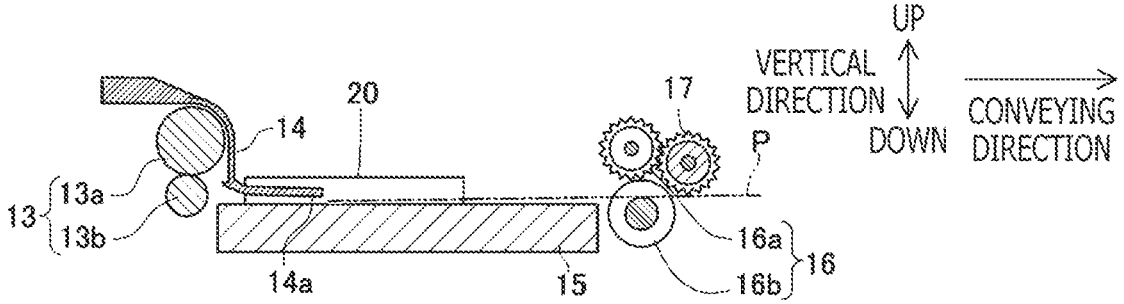

FIG. 8A illustrates a recordable sheet being nipped by a conveyer roller but not nipped by an ejection roller in the recorder according to the embodiment of the present disclosure. FIG. 8B illustrates the recordable sheet being nipped by the conveyer roller and the ejection roller in the recorder according to the embodiment of the present disclosure. FIG. 8C illustrates the recordable sheet being nipped by the ejection roller but not nipped by the conveyer roller in the recorder according to the embodiment of the present disclosure. FIG. 8D illustrates the recordable sheet, of which an upstream end in a conveying direction exited a pressing portion in the recorder, according to the embodiment of the present disclosure.

Figure 9:
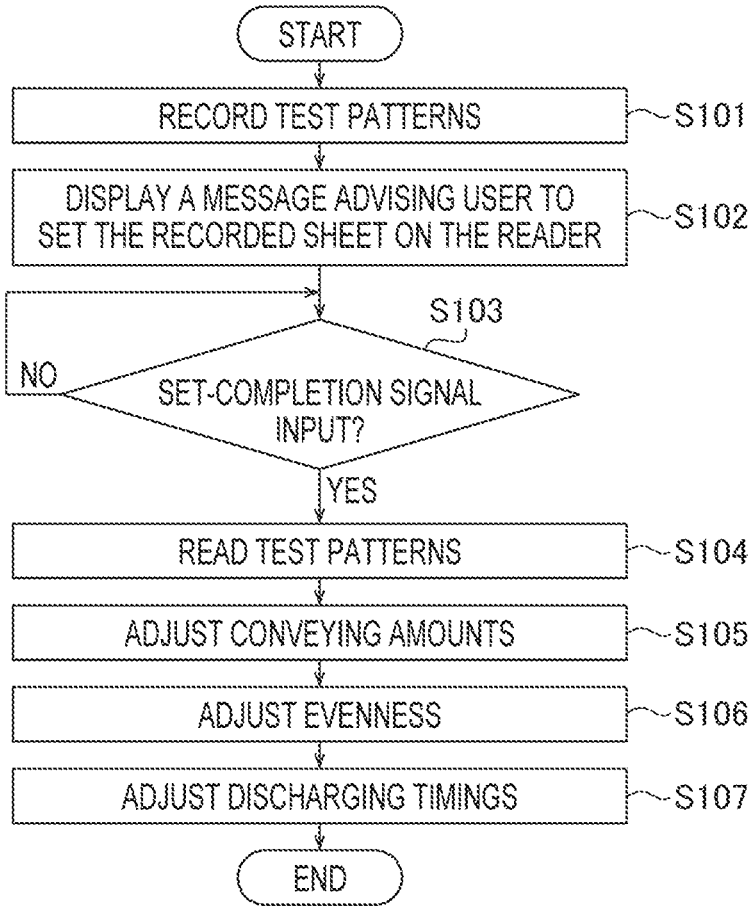

FIG. 9 is a flowchart to illustrate a flow of steps to be conducted by a controller in the inkjet printer to adjust settings in the recorder according to the embodiment of the present disclosure.

Figure 10:
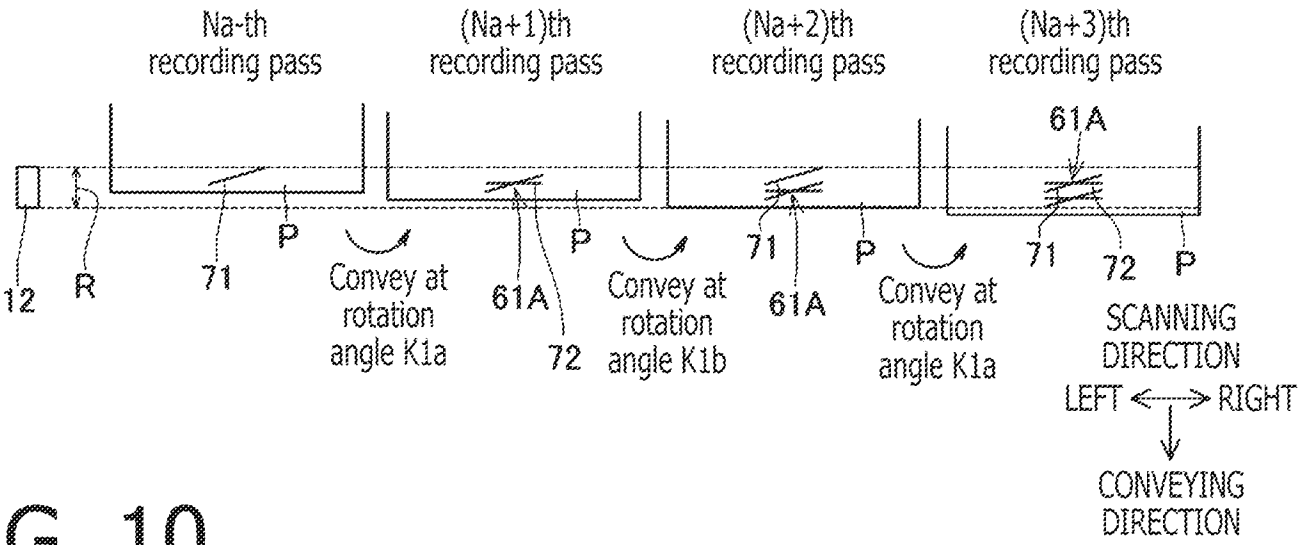

FIG. 10 illustrates a procedure to record the conveyance adjuster pattern on a downstream side in the conveying direction by the recorder according to the embodiment of the present disclosure.

Figure 11:
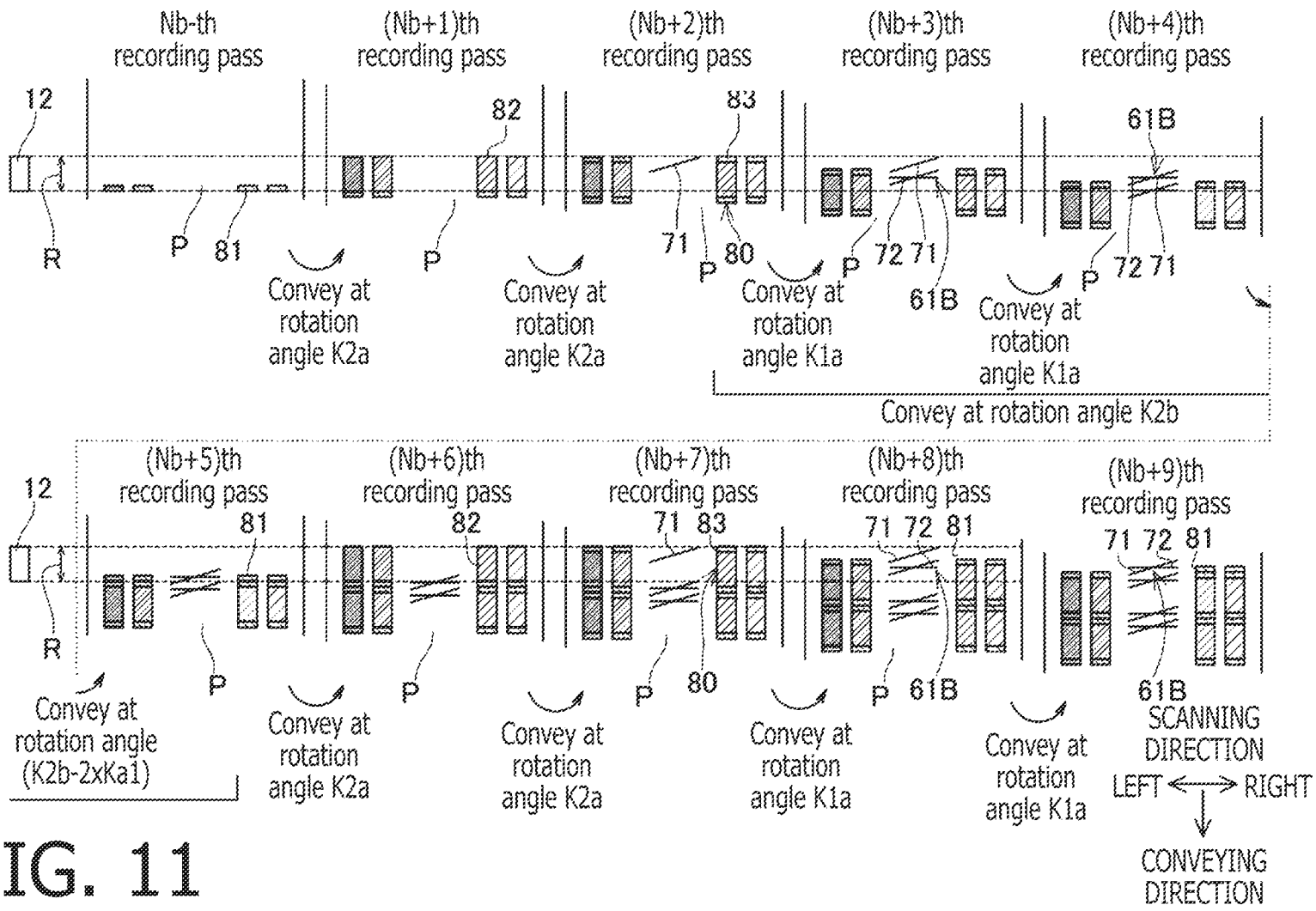

FIG. 11 illustrates a procedure to record the evenness adjuster pattern and the conveyance adjuster pattern side by side along a scanning direction by the recorder according to the embodiment of the present disclosure.

Figure 12:
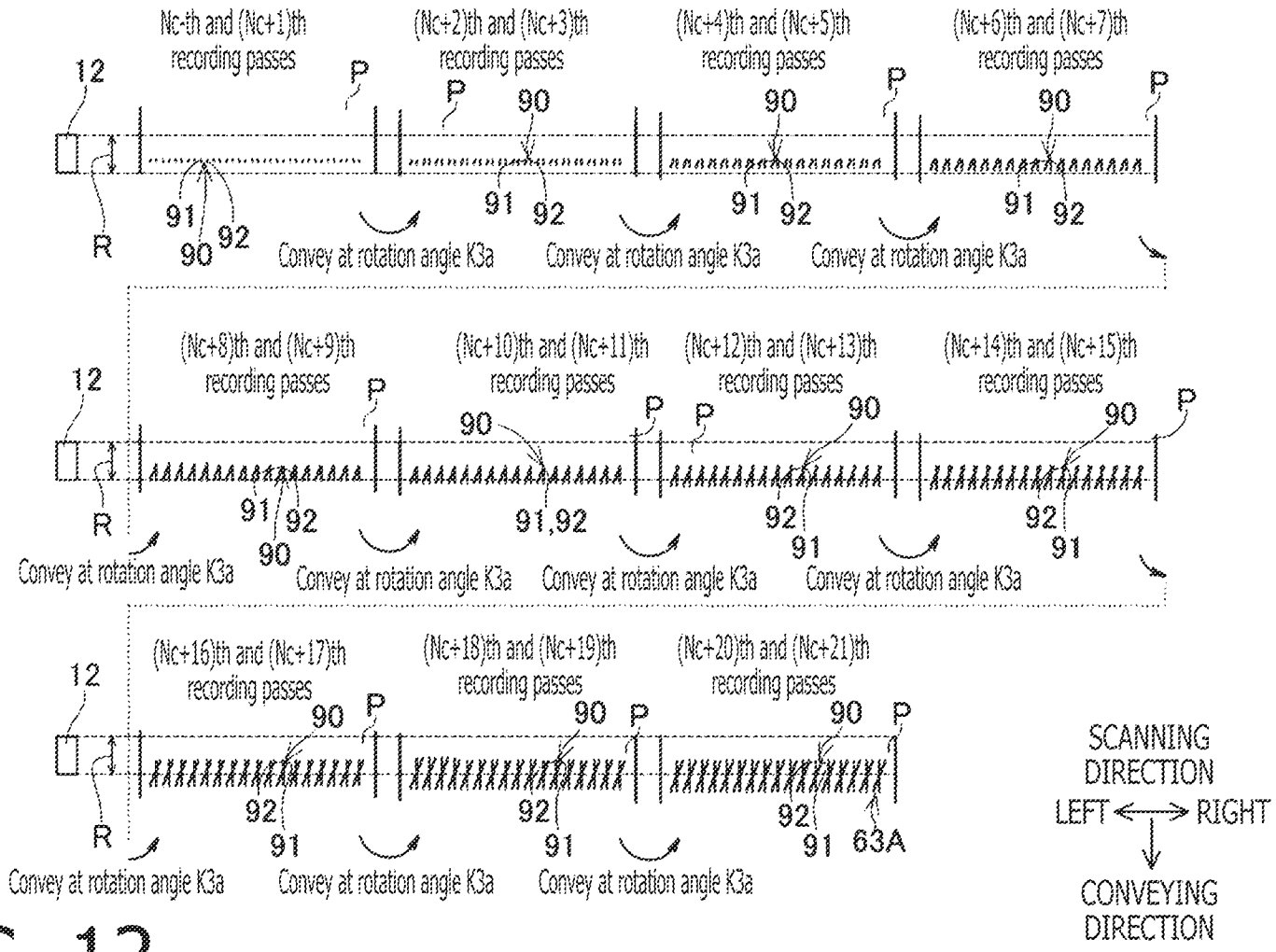

FIG. 12 illustrates a procedure to record the timing adjuster pattern arranged along the scanning direction in an entire length of the recordable sheet by the recorder according to the embodiment of the present disclosure.

Figure 13:
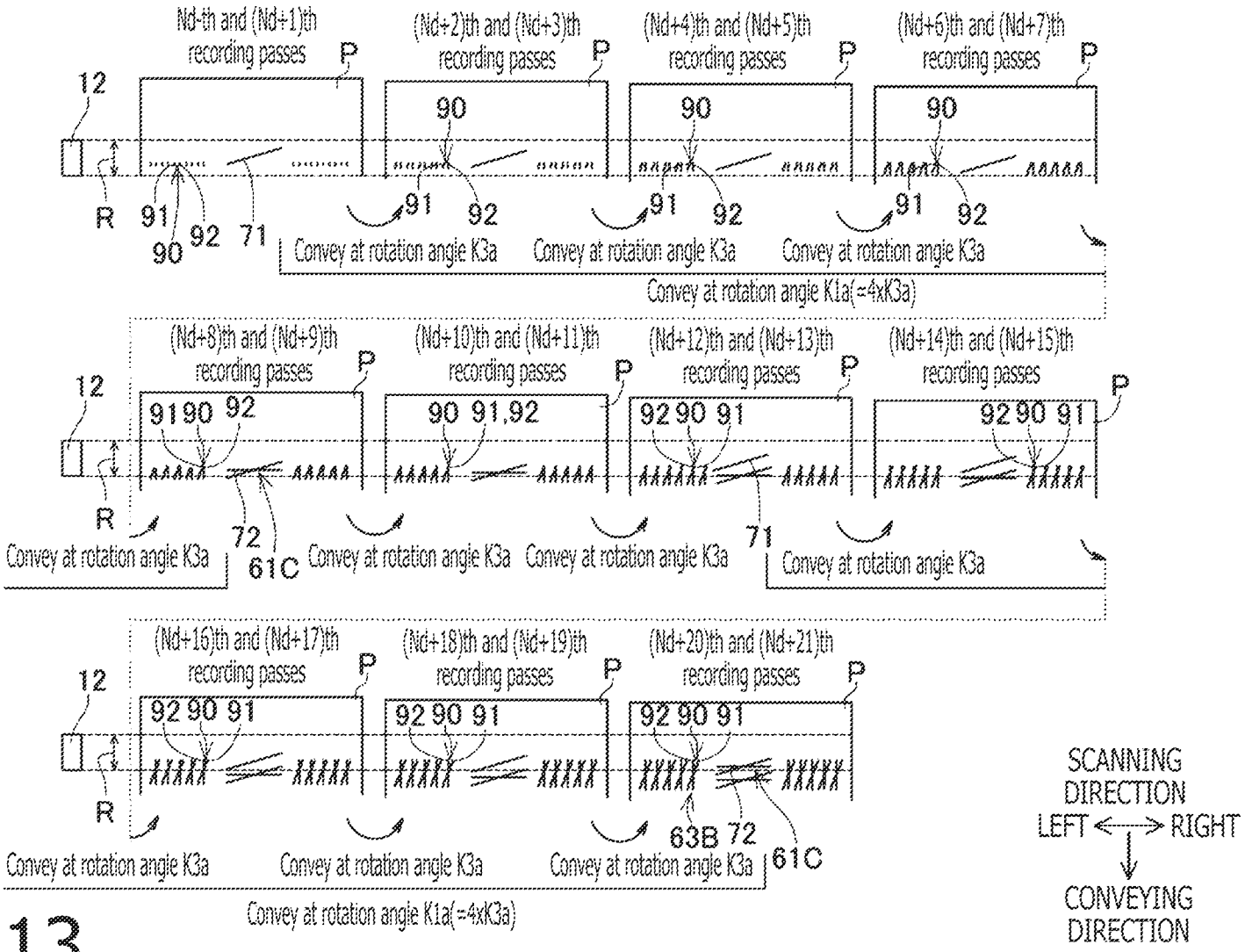

FIG. 13 illustrates a procedure to record the timing adjuster pattern and the conveyance adjuster pattern side by side along the scanning direction by the recorder according to the embodiment of the present disclosure.

Figure 14A:
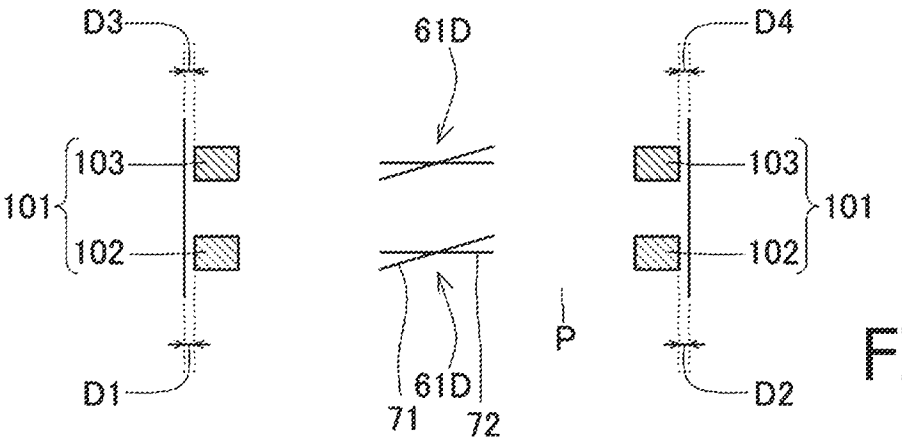
Figure 14B:
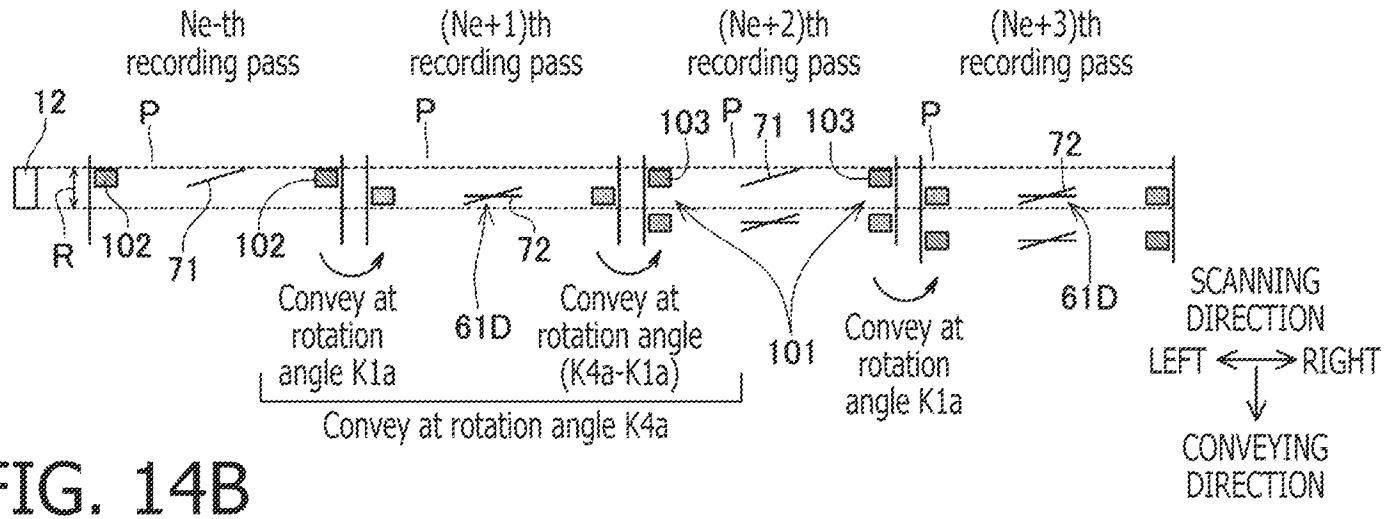

FIG. 14A illustrates the conveyance adjuster pattern and a margin adjuster pattern recordable by the recorder according to a first modified example of the embodiment of the present disclosure. FIG. 14B illustrates a procedure to record the conveyance adjuster pattern and the margin adjuster pattern in the first modified example of the embodiment of the present disclosure.

Figure 15A:
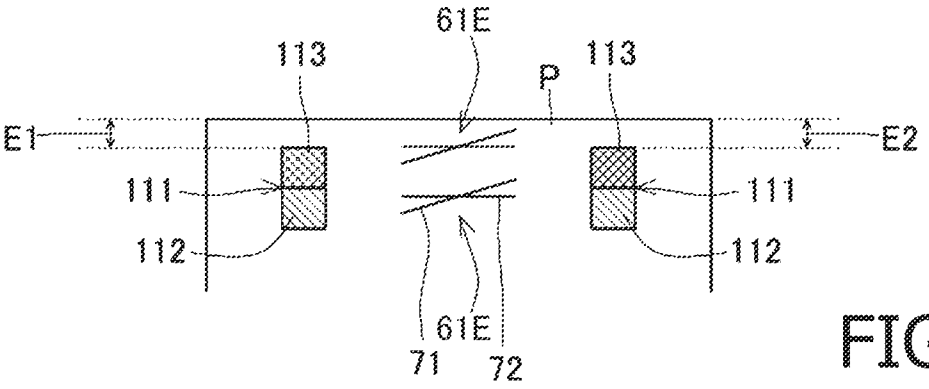
Figure 15B:
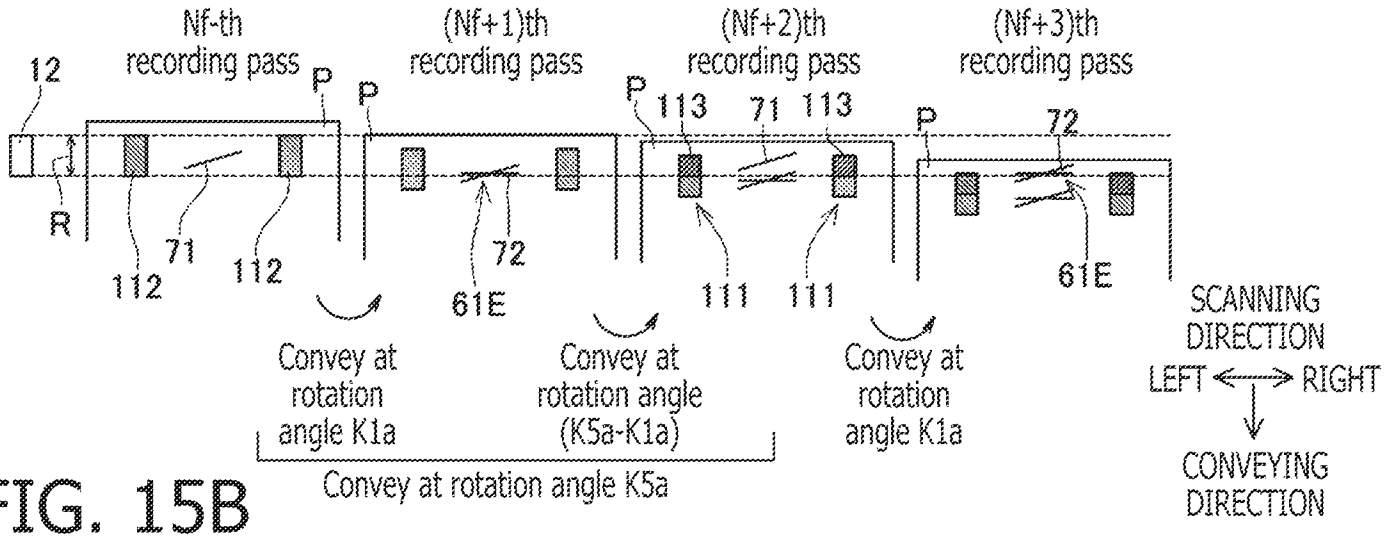

FIG. 15A illustrates the conveyance adjuster pattern and the margin adjuster pattern recordable by the recorder according to a second modified example of the embodiment of the present disclosure. FIG. 15B illustrates a procedure to record the conveyance adjuster pattern and the margin adjuster pattern in the second modified example of the embodiment of the present disclosure.

Figure 16A:
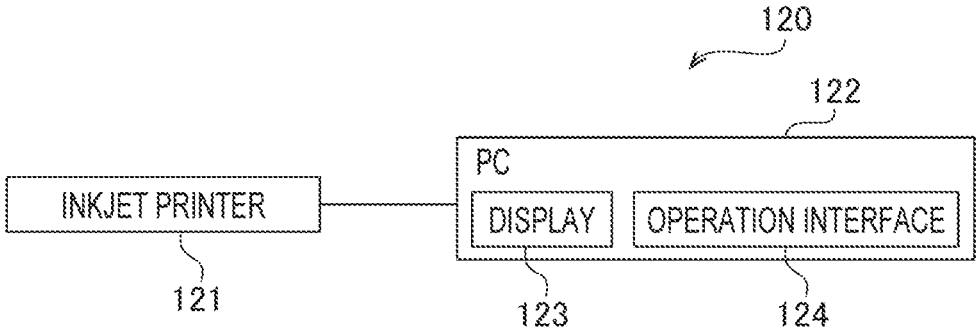
Figure 16C:
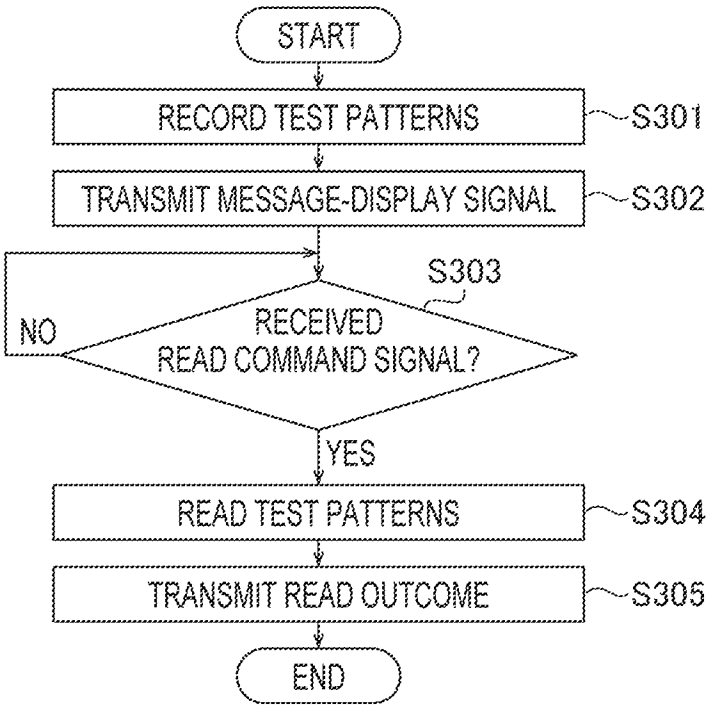
Figure 16B:
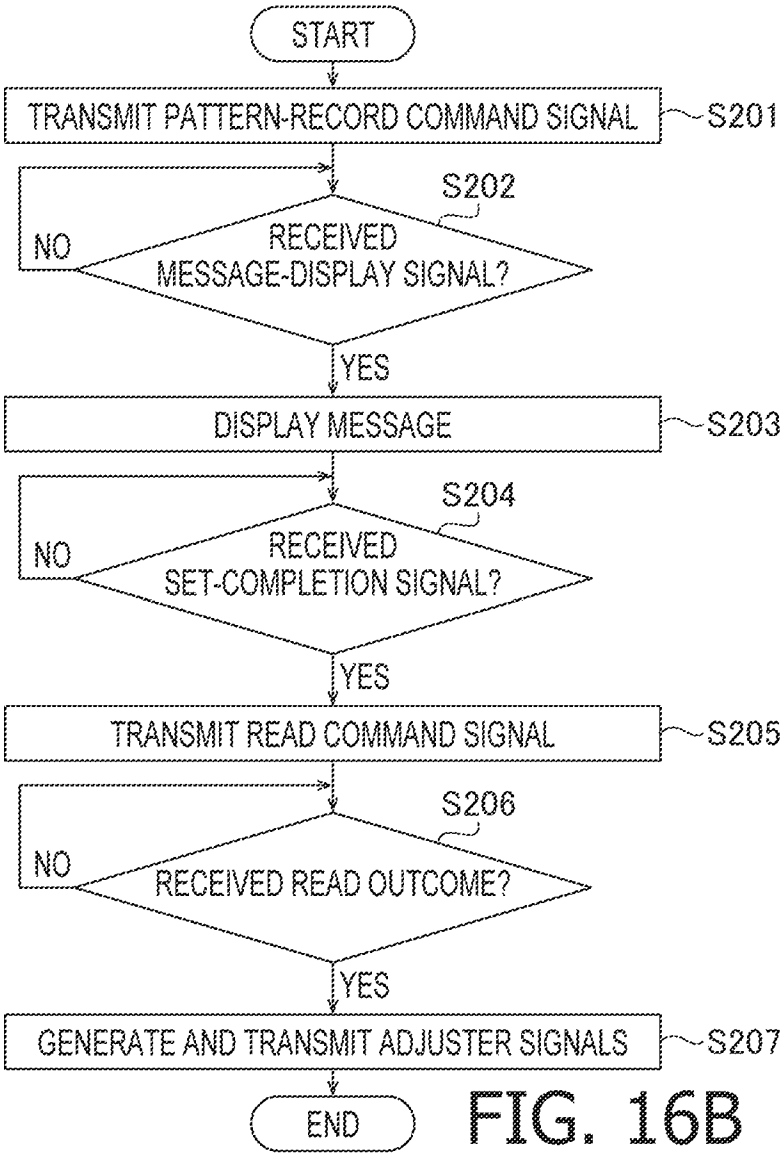

FIG. 16A is a block diagram to illustrate a system in a third modified example of the embodiment of the present disclosure. FIG. 16B is a flowchart to illustrate a flow of steps to be conducted by a PC to adjust settings in the recorder in the third modified example of the embodiment of the present disclosure. FIG. 16C is a flowchart to illustrate a flow of steps to be conducted by a controller in an inkjet printer to adjust the settings in the recorder in the third modified example of the present disclosure.

DETAILED DESCRIPTION

Hereinafter, embodiments according to an aspect of the present disclosure will be described in detail with reference to the accompanying drawings.

It may be noted that various connections may be set forth between elements in the following description. These connections in general and, unless specified otherwise, may be direct or indirect and that this specification is not intended to be limiting in this respect. Aspects of the disclosure may be implemented in computer software as programs storable on computer readable media including but not limited to a random access memory (RAM), a read-only memory (ROM), a flash memory, an electrically erasable ROM (EEPROM), a CD-media, DVD-media, temporary storage, hard disk drives, floppy drives, permanent storage, and the like.

<Overall Configuration of Multifunction Peripheral Machine>

Figure 1:
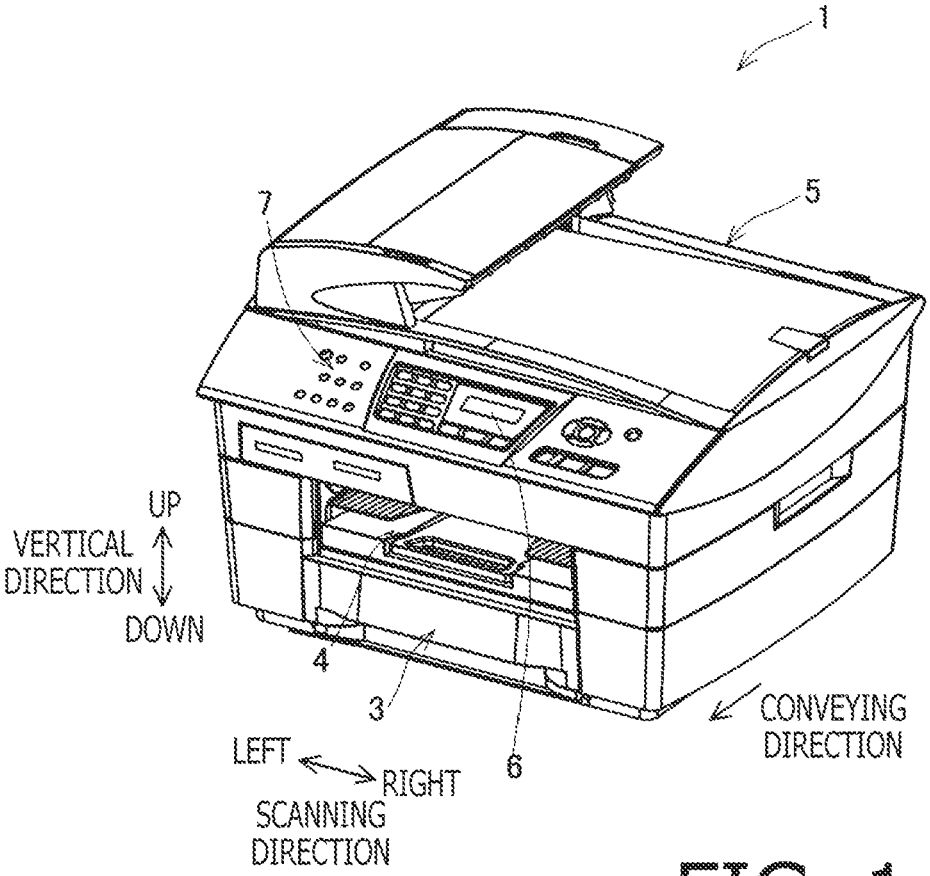
FIG. 1 is an overall perspective view of a multifunction peripheral machine including an inkjet printer according to an exemplary embodiment of the present disclosure.

An inkjet printer 1 of the embodiment of the present disclosure may be a multifunction peripheral machine (MFP) having a plurality of functions such as a recording function to record an image on a recordable sheet P and an image reading function to read an image on a readable medium. The inkjet printer 1 includes, as shown in FIG. 1, a recorder 2 (see FIG. 2), a feeder 3, an ejector 4, a reader 5, an operation interface 7, and a display 6. Further, the inkjet printer 1 includes a controller 50 (see FIG. 5) configured to control operations and actions in the inkjet printer 1.

The recorder 2 is disposed inside the inkjet printer 1. The recorder 2 is configured to record an image on the recordable sheet P. A detailed configuration of the recorder 2 will be described further below. The feeder 3 may feed the recordable sheet P to the recorder 2. The ejector 4 may eject the recordable sheet P, on which an image is recorded by the recorder 2, outside. The reader 5 may be an image scanner and may read images on original sheets. The display 6 may be a liquid crystal display, which may display information when the inkjet printer 1 is being used. The operation interface 7 may include buttons and a touch panel arranged in the display 6 and may receive signals corresponding to a user's operations to the operation interface 7.

<Configuration of Recorder>

Figure 2:
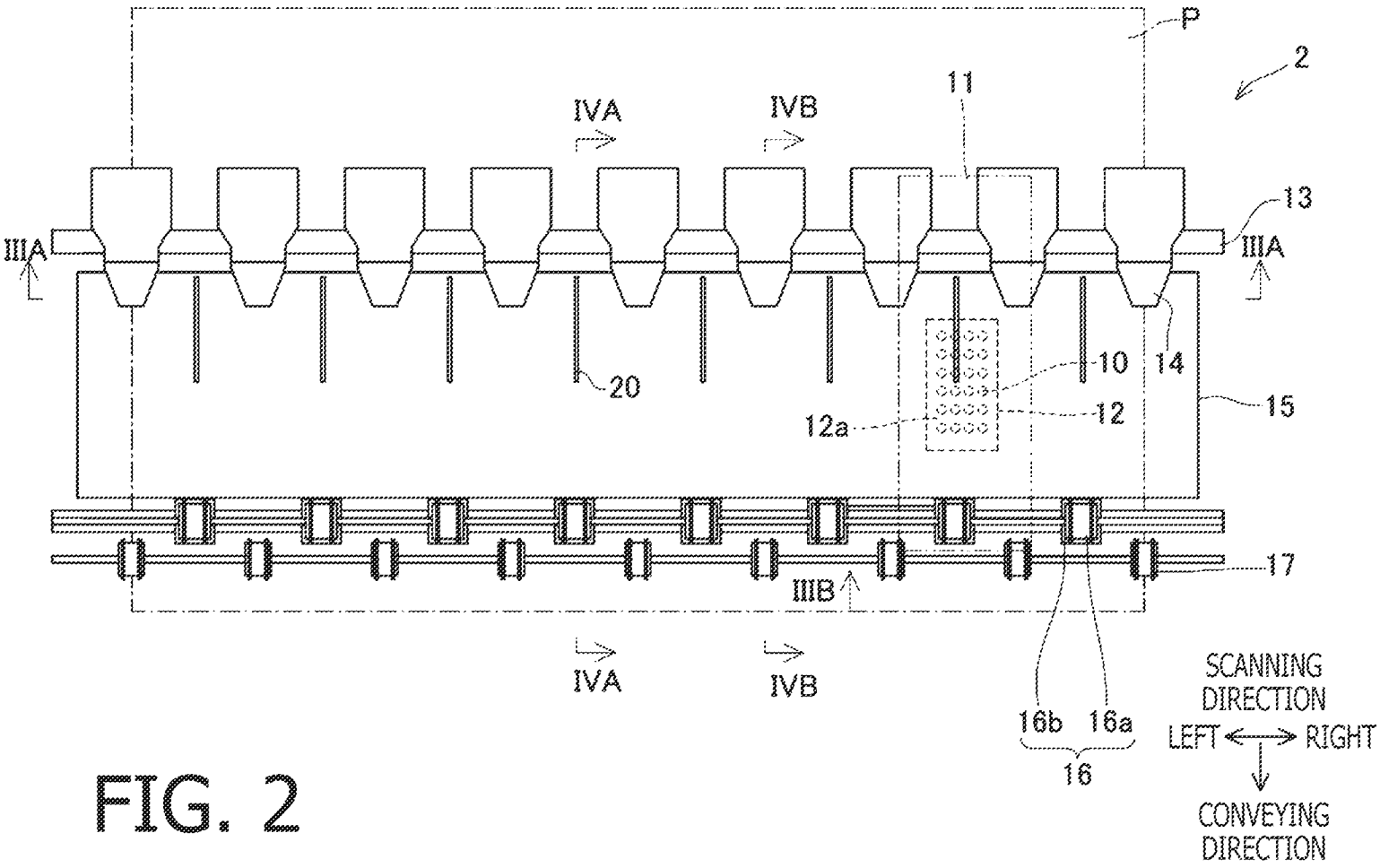
FIG. 2 is a plan view of a recorder in the inkjet printer according to the embodiment of the present disclosure.
Figure 3A:
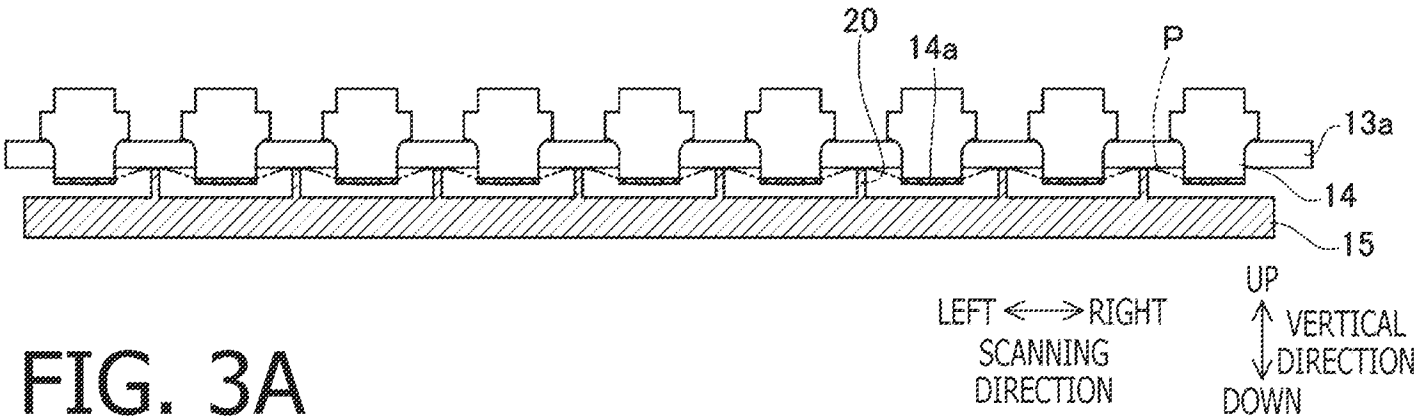
FIG. 3A illustrates a part of the recorder according to the embodiment of the present disclosure viewed along an arrow IIIA shown in FIG. 2.
Figure 3B:
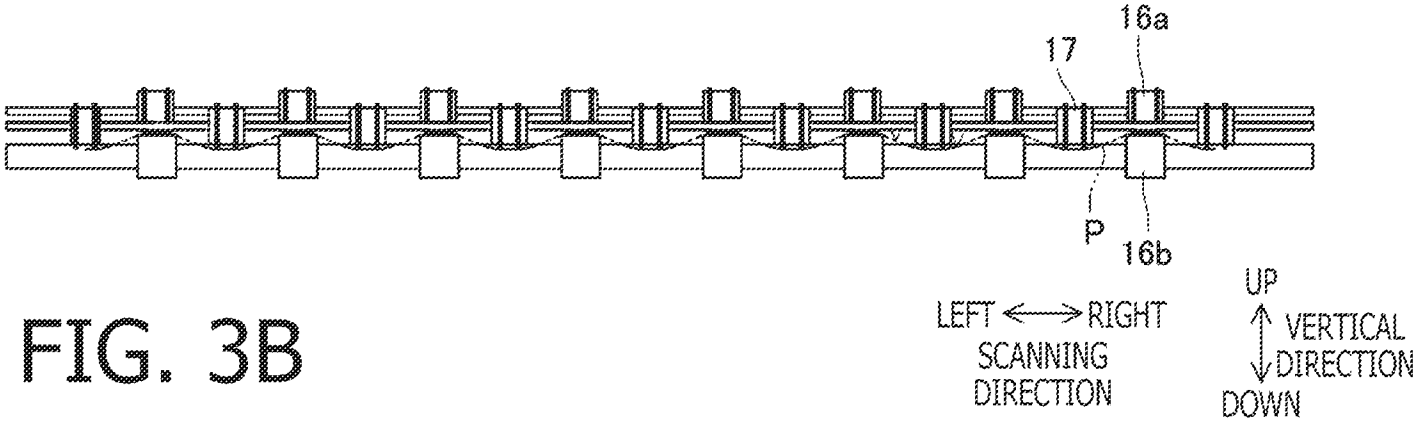
FIG. 3B illustrates a part of the recorder according to the embodiment of the present disclosure viewed along an arrow IIIB shown in FIG. 2.
Figure 4A:
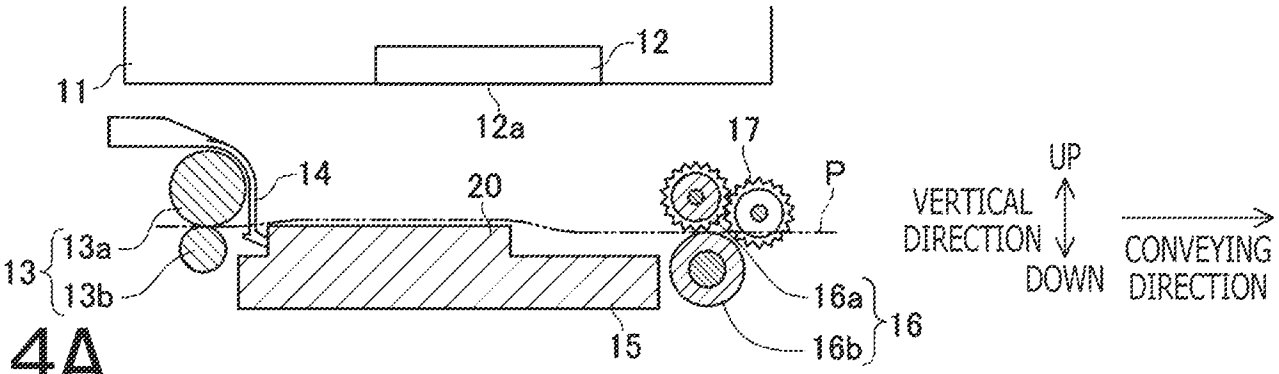
FIG. 4A is a cross-sectional view at a section along a line IVA-IVA shown in FIG. 2 according to the embodiment of the present disclosure.
Figure 4B:
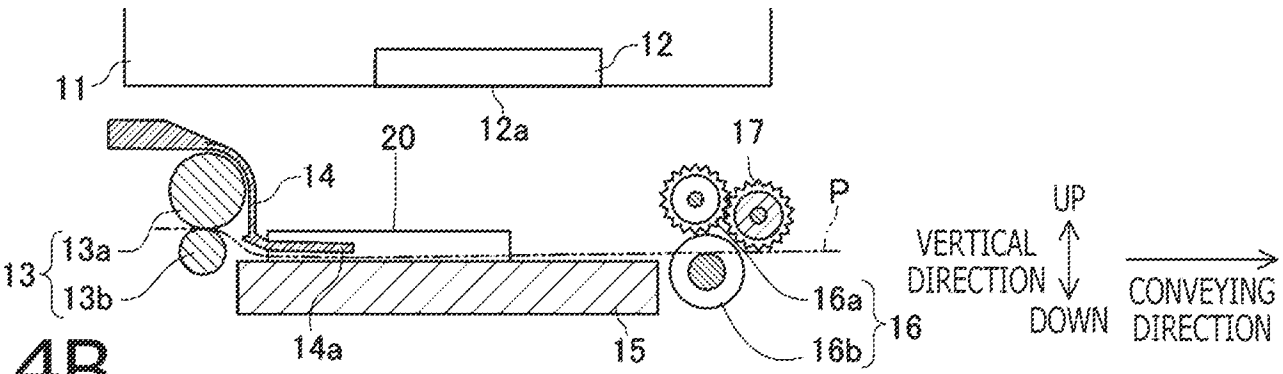
FIG. 4B is a cross-sectional view at a section along a line IVB-IVB shown in FIG. 2 according to the embodiment of the present disclosure.

The recorder 2 will be described below. As shown in FIGS. 2-4, the recorder 2 includes a carriage 11, an inkjet head 12, a conveyer roller 13, a platen 15, a plurality of corrugating plates 14, a plurality of ejection rollers 16, and a plurality of corrugating spur wheels 17. It may be noted that, to aid visual understanding of the structure of the recorder 2, in FIG. 2, the carriage 11 in an exemplary position is drawn in a dash-and-two-dots line, and items disposed below the carriage 11 are drawn in solid lines. Further, in FIG. 2, illustration of some of structures that support the carriage 11, e.g., a guiderail, may be omitted.

The carriage 11 is supported by the guide rail (not shown) and may move on the guiderail in a scanning direction. In the present embodiment, the scanning direction includes a leftward (right-to-left) direction and a rightward (left-to-right) direction (see FIGS. 1 and 2, for example) and may be referred to as a widthwise direction. The carriage 11 is connected with a carriage motor 56 (see FIG. 5) through a belt (not shown) to be moved to reciprocate in the scanning direction. In the following description, one end on the left and the other end on the right in the scanning direction will be defined as a leftward end and a rightward end, respectively.

The inkjet head 12 is mounted on the carriage 11 to be moved along with the carriage 11. The inkjet head 12 may perform a discharging action to discharge ink through a plurality of nozzles 10 formed in an ink discharging surface 12*a*, which may be a lower surface of the inkjet head 12, to record dots forming an image on the recordable sheet P. The nozzles 10 are arrayed in line along a conveying direction that extends orthogonally to the scanning direction to form a nozzle array 9. Further, in the inkjet head 12, a plurality of, e.g., four (4), nozzle arrays 9 are formed so that inks in four colors, e.g., black, yellow, cyan, and magenta, may be discharged separately from each nozzle array 9.

The conveyer roller 13 is arranged at a position upstream from the inkjet head 12 in the conveying direction to convey the recordable sheet P. The conveyer roller 13 includes an upper roller 13*a* and a lower roller 13*b*, which may nip therebetween the recordable sheet P fed by the feeder 3 and convey the recordable sheet P from upstream to downstream, or from one side toward the other side, in the conveying direction. The upper roller 13*a* may be driven to rotate by a conveyer motor 57 (see FIG. 5), and the lower roller 13*b* may be rotated passively along with rotation of the upper roller 13*a*.

The plurality of corrugating plates 14 are disposed to extend from a position coincident with the conveyer roller 13 to a position downstream from the conveyer roller 13 in the conveying direction. The corrugating plates 14 are arranged to be spaced apart evenly from one another at an interval along the scanning direction. Each of the corrugating plates 14 includes a presser 14*a*, which may press the recordable sheet P downward, at a downstream end thereof with regard to the conveying direction.

The platen 15 is arranged at a position downstream from the conveyer roller 13 in the conveying direction to face the ink discharging surface 12*a* of the inkjet head 12. The platen 15 is arranged to longitudinally extend in the scanning direction to cover an entire movable range of the carriage 11 that is movable to reciprocate during a recording operation. On an upper surface of the platen 15, formed are a plurality of ribs 20, which extend in the conveying direction. The ribs 20 are arranged to be spaced apart evenly from one another at the interval along the scanning direction at positions between adjoining corrugating plates 14.

The ejection rollers 16 are arranged at positions downstream from the inkjet head 12 in the conveying direction. The ejection rollers 16 are located at the same positions as the ribs 20 in the scanning direction. Each ejection roller 16 includes an upper roller 16*a* and a lower roller 16*b*, between which the recordable sheet P may be nipped from above and below to be conveyed in the conveying direction. The ejection rollers 16 thus convey the recordable sheet P in the conveying direction toward the ejector 4. The lower rollers 16*b* may be driven to rotate by the conveyer motor 57 (see FIG. 5). The upper rollers 16*a* are spur wheels and may be rotated passively by the rotation of the lower rollers 16*b*. The upper rollers 16*a* may contact a recorded surface of the recordable sheet P, which is a surface having an image recorded thereon in the recording operation. However, while the upper rollers 16*a* are spurs, of which outer circumferences are not smooth, the ink in the recorded image on the recordable sheet P may be restrained from being adhering to the upper rollers 16*a*. Thus, the conveyer roller 13 and the ejection rollers 16 may convey the recordable sheet P. The conveyer roller 13 and the ejection rollers 16 may convey the recordable sheet P to move relatively in the conveying direction to the inkjet head 12.

The corrugating spur wheels 17 are arranged at positions downstream from the ejection rollers 16 in the conveying direction. The corrugating spur wheels 17 are substantially at the same positions as the pressers 14*a* of corrugating plates 14 in the scanning direction. Meanwhile, the corrugating spur wheels 17 are located at a position lower than the upper rollers 16*a* of the ejection rollers 16. Therefore, the corrugating spur wheels 17 support the recordable sheet P from above at a position lower than the position, at which the ejection rollers 16 nip the recordable sheet P. Meanwhile, however, lower ends of the corrugating spur wheels 17 are located at a position higher than the pressers 14*a* of the corrugating plates 14. Therefore, an intensity of the corrugating spur wheels 17 to press the recordable sheet P may be smaller than an intensity of the corrugating plate 14 pressing the recordable sheet P. Therefore, the ink on the recordable sheet P may be restrained from adhering to the corrugating spur wheels 17. Moreover, the corrugating spur wheels 17 are not rollers with smooth outer circumferences but spur wheels. Therefore, the ink on the recordable sheet P may be restrained from adhering to the corrugating spur wheels 17 effectively.

Thus, the recordable sheet P may be supported by the ribs 20 and the lower rollers 16*b* on a lower surface from below and by the pressers 14*a* of the corrugating plates 14 and the corrugating spur wheels 17 on the upper surface from above to be shaped into the corrugated form, as shown in FIGS. 3 and 4, which waves up and down along the scanning direction.

<Controller>

Next, explanation of the controller 50 for controlling operations and processes in the inkjet printer 1 will be provided below. The controller 50 includes, as shown in FIG. 5, a central processing unit (CPU) 51, a read-only memory (ROM) 52, a random access memory (RAM) 53, a flash memory 54, and an application specific integrated circuit (ASIC) 55.

The controller 50 controls actions of the carriage motor 56, the inkjet head 12, the conveyer motor 57, the reader 5, and the display 6. Further, the controller 50 may receive various types of signals from the reader 5 and signals corresponding to operations to the operation interface 7. Meanwhile, the recorder 2 includes a rotary encoder 58 disposed on the upper roller 13A. The controller 50 may receive a signal from the rotary encoder 58 each time the upper roller 13*a* rotates by a predetermined angle. Thus, a conveyed amount of the recordable sheet P may be determined by a rotation angle of the upper roller 13*a*, which may be based on the signals from the rotary encoder 58. However, optionally, the rotary encoder 58 may be disposed on another roller, such as the lower rollers 16*b*, and the conveyed amount of the recordable sheet P may be determined by a rotation angle of the another roller.

Figure 5:
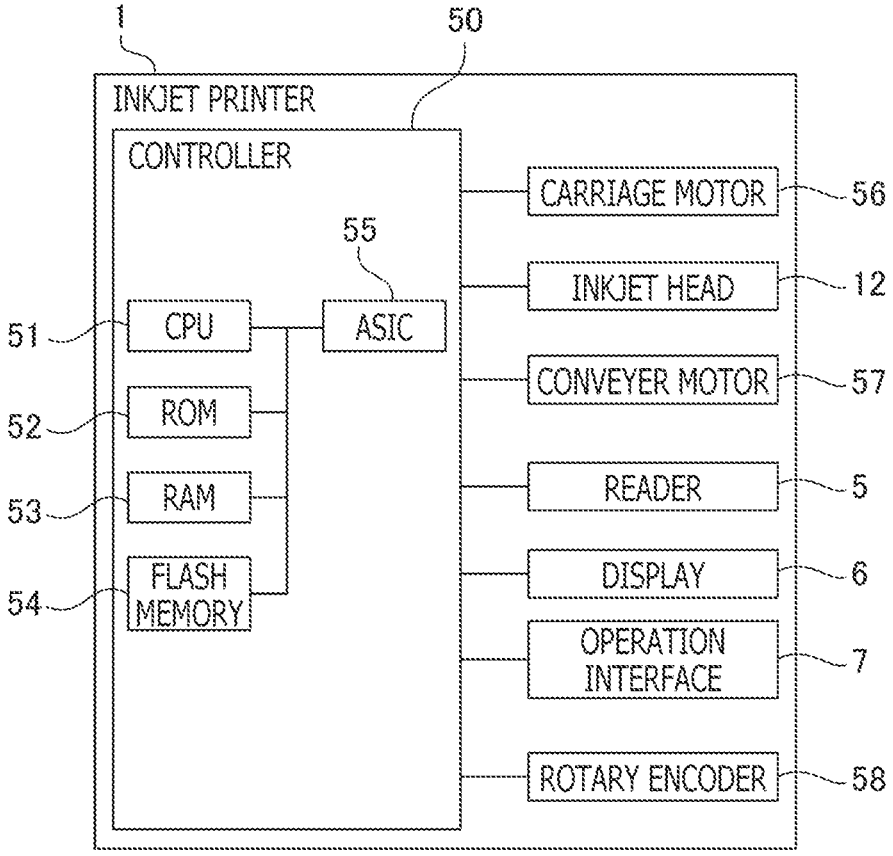
FIG. 5 is a block diagram to illustrate an electrical configuration of the inkjet printer according to the embodiment of the present disclosure.

While FIG. 5 shows solely one (1) CPU 51 to process the signals in the controller 50, the CPU 51 may not necessarily be limited to a single CPU 51 that processes the signals alone but may include a plurality of CPUs 51 that may share the loads of the signal-processing. Further, the ASIC 55 in the controller 50 may not necessarily be limited to a single ASIC that processes the signals alone but may include multiple ASICs 55 that may share the loads of the signal-processing.

<Test Patterns>

Figure 6:
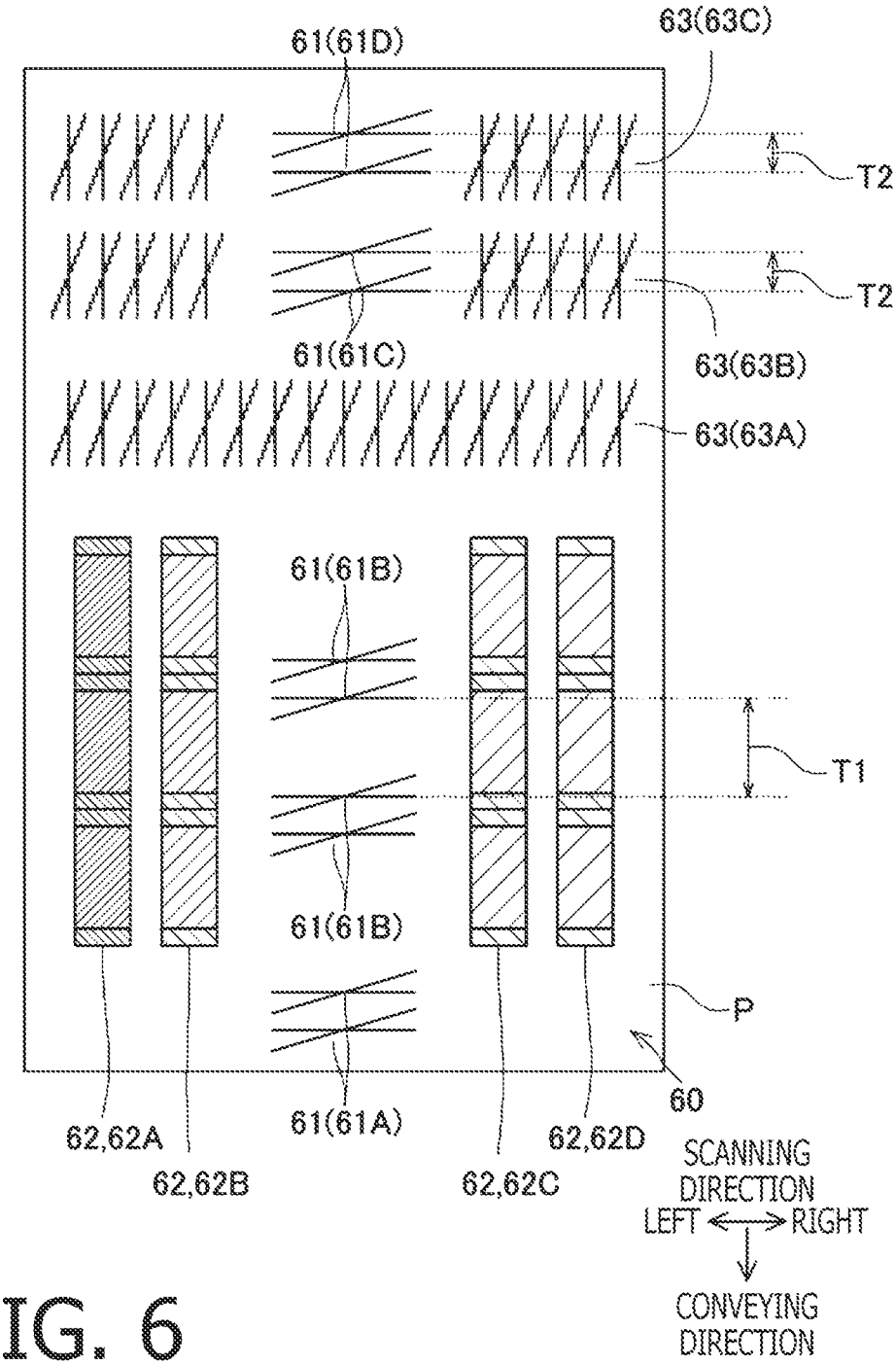
FIG. 6 shows test patterns recordable by the recorder in the inkjet printer according to the embodiment of the present disclosure.

Next, test patterns recordable by the recorder 2 in the inkjet printer 1 will be described below. The recorder 2 may record test patterns 60 as shown in FIG. 6. Data for recording the test patterns 60 may be stored in, for example, the flash memory 54.

The test patterns 60 may include ten (10) sets of conveyance adjuster patterns 61, four (4) sets of evenness adjuster patterns 62, and a plurality of sets of timing adjuster patterns 63.

<Conveyance Adjuster Pattern>

Each conveyance adjuster pattern 61 includes, as shown in FIG. 7A, a first pattern piece 71 and a second pattern piece 72. The first pattern piece 71 is a straight line inclining with respect to the scanning direction. The second pattern piece 72 is a straight line parallel to the scanning direction. As will be described further below, the second pattern piece 72 is recordable on the recordable sheet P placed in a condition after having been conveyed by the conveyer roller 13 and the ejection rollers 16 in the conveying direction from a previous position, in which the first pattern piece 71 was recorded, by a distance corresponding to rotation of the upper roller 13*a* rotated at a rotation angle K1*a*.

In this condition of the recordable sheet P, when the actually conveyed amount of the recordable sheet P is equal to an expected conveyance amount, the second pattern piece 72 may be recorded on the recordable sheet P in an arrangement, in which an intersection between the first pattern piece 71 and the second pattern piece 72 is located at a center of the first pattern piece 71 and the second pattern piece 72, as drawn in a solid line in FIG. 7A.

When, on the other hand, the actually conveyed amount of the recordable sheet P is larger than the expected conveyance amount, the second pattern piece 72 may be recorded on the recordable sheet P at a position displaced upstream in the conveying direction, as drawn in a broken line FIG. 7A. Therefore, an intersection 73 between the first pattern piece 71 and the second pattern piece 72 is displaced rightward from the center of the first pattern piece 71 and the second pattern piece 72. In particular, the larger the difference between the actually conveyed amount of the recordable sheet P and the expected conveyance amount is, by the larger amount the intersection 73 may be displaced from the center of the first pattern piece 71 and the second pattern piece 72.

Or, when the actually conveyed amount of the recordable sheet P is smaller than the expected conveyance amount, the second pattern piece 72 may be recorded on the recordable sheet P at a position displaced downstream in the conveying direction, as drawn in a dash-and-dot line FIG. 7A. Therefore, the intersection 73 between the first pattern piece 71 and the second pattern piece 72 is displaced leftward from the center of the first pattern piece 71 and the second pattern piece 72. In particular, the larger the difference between the actually conveyed amount of the recordable sheet P and the expected conveyance amount is, by the larger amount the intersection 73 may be displaced from the center of the first pattern piece 71 and the second pattern piece 72.

Thus, the conveyance adjuster patterns 61 recorded on the recordable medium P may optically or visually express the difference between the actually conveyed amount of the recordable sheet P and the expected conveyance amount. Therefore, based on the recorded outcome, in other words, based on the position of the intersection 73 in the conveyance adjuster pattern 61, the actually conveyed amount of the recordable sheet P may be recognized, and an amount to convey the recordable sheet P in the conveying direction, i.e., a rotation angle of the upper roller 13*a*, may be adjusted.

The ten sets of conveyance adjuster patterns 61 may consist of two (2) sets of conveyance adjuster patterns 61A, four (4) sets of conveyance adjuster patterns 61B, two (2) sets of conveyance adjuster patterns 61C, and two (2) sets of conveyance adjuster patterns 61D.

The two sets of conveyance adjuster patterns 61A are arranged on the recordable sheet P on a downstream side in the conveying direction to be spaced apart from each other in the conveying direction. The four sets of conveyance adjuster patterns 61B are arranged on the recordable sheet P on an upstream side in the conveying direction with respect to the two conveyance adjuster patterns 61A to be spaced apart from one another in the conveying direction. The two sets of conveyance adjuster patterns 61C are arranged on the recordable sheet P on an upstream side in the conveying direction with respect to the four sets of conveyance adjuster patterns 61B to be spaced apart from each other in the conveying direction. The two sets of conveyance adjuster patterns 61D are arranged on the recordable sheet P on an upstream side in the conveying direction with respect to the two sets of conveyance adjuster pattern 61C to be spaced apart from each other in the conveying direction.

The recordable sheet P conveyed by the conveyer roller 13 and the ejection rollers 16 in the conveying direction may be in one of conditions shown in FIGS. 8A-8D. In the condition shown in FIG. 8A, an end of the recordable sheet P on a downstream side in the conveying direction has not reached the ejection rollers 16; therefore, the recordable sheet P is nipped by the conveyer roller 13 but is not nipped by the ejection rollers 16.

The recordable sheet P conveyed downstream from the position shown in FIG. 8A may reach the ejection rollers 16 as shown in FIG. 8B. That is, in the condition shown in FIG. 8B, the recordable sheet P is nipped both by the conveyer roller 13 and the ejection rollers 16.

As the recordable sheet P is conveyed further downstream from the position shown in FIG. 8B, an end of the recordable sheet P on an upstream side in the conveying direction may leave the conveyer roller 13 and may be located on a downstream side of the conveyer roller 13 in the conveying direction. That is, in the condition shown in FIG. 8C, the recordable sheet P is not nipped by the conveyer roller 13 but is nipped by the ejection rollers 16.

In the conditions shown in FIGS. 8A-8C, the recordable sheet P may be pressed by the pressers 14*a* from above. As the recordable sheet P is conveyed downstream from the position shown in FIG. 8C, the upstream end of the recordable sheet P may be located downstream from the pressers 14*a* in the conveying direction, as shown in FIG. 8D. In the condition shown in FIG. 8D, the recordable sheet P is not nipped by the conveyer roller 13 but is nipped by the ejection rollers 16, and is not pressed by the pressers 14*a*.

The conveyance adjuster patterns 61A may be recorded in an area, which faces the nozzles 10 of the inkjet head 12, on the recordable sheet P in the condition shown in FIG. 8A. The conveyance adjuster patterns 61B may be recorded in an area, which faces the nozzles 10 of the inkjet head 12, on the recordable sheet P in the condition shown in FIG. 8B. The conveyance adjuster patterns 61C may be recorded in an area, which faces the nozzles 10 of the inkjet head 12, on the recordable sheet P in the condition shown in FIG. 8C. The conveyance adjuster patterns 61D may be recorded in an area, which faces the nozzles 10 of the inkjet head 12, on the recordable sheet P in the condition shown in FIG. 8D.

Meanwhile, the actually conveyed amount of the recordable sheet P with respect to the rotation angle of the upper roller 13*a* may depend on the conditions, whether the recordable sheet P is nipped by the conveyer roller 13 and/or the ejection rollers 16 and whether the recordable sheet P is pressed by the pressers 14*a*. In this regard, in the present embodiment, by recording the conveyance adjuster patterns 61A-61D in the different areas on the recording sheet P, amounts to convey the recordable sheet P may be suitably adjusted in accordance with the conditions of the recordable sheet P, which are illustrated in FIGS. 8A-8D.

<Evenness Adjuster Pattern>

The evenness adjuster patterns 62 are plain color-filled bars extending in the conveying direction. As shown in FIG. 7B, each evenness adjuster pattern 62 includes three (3) bar pieces 80 aligning continuously in the conveying direction. In other words, each evenness adjuster pattern 62 includes a bar piece 80 on a downstream side in the conveying direction, a bar piece 80 at a center in the conveying direction, and a bar piece 80 on an upstream side in the conveying direction. Each bar piece 80 includes a first plain part 81, a second plain part 82, and a second plain part 83.

The first plain part 81 may be recorded in ink discharged from the inkjet head 12 through the nozzles 10 located at a downstream end of the inkjet head 12 in the conveying direction.

The second plain part 82 is located on an upstream side of the first plain part 81 in the conveying direction continuously with the first plain part 81. The second plain part 82 may be recorded in ink discharged through all of the nozzles 10 in the inkjet head 12 on the recordable sheet P located at a position having been conveyed from a previous position, at which the first plain part 81 was recorded, by an amount equal to a length of the first plain part 81 in the conveying direction.

The third plain part 83 is located on an upstream side of the second plain part 82 in the conveying direction continuously with the second plain part 82. The third plain part 83 may be recorded in ink discharged through the nozzles 10 located at an upstream end of the inkjet head 12 in the conveying direction, on the recordable sheet P at a position having been conveyed from the previous position, at which the second plain part 82 was recorded, by an amount equal to a length of the third plain part 83 in the conveying direction.

In each of the bar pieces 80 at the center and the upstream side in the conveying direction, the first plain part 81 may be recorded on the recordable sheet P at a position having been conveyed from the previous position, at which the third plain part 83 aligning immediately downstream and adjacent thereto in the conveying direction, by a distance equal to a length of the nozzle array 9 in the conveying direction. In other words, after recording the third plain part 83 for the bar piece 80 on the downstream side, the recordable sheet P may be conveyed by a distance equal to the length of the nozzle array 9 in the conveying direction, and the first plain part 82 for the bar piece 80 at the center in the conveying direction may be recorded; and after recording the third plain part 83 for the bar piece 80 at the center in the conveying direction, the recordable sheet P may be conveyed by the distance equal to the length of the nozzle array 9 in the conveying direction, and the first plain part 82 for the bar piece 80 on the upstream side in the conveying direction may be recorded.

Among the four sets of evenness adjuster patterns 62, the two sets of the evenness adjuster patterns 62A, 62B are located on a leftward side of the four sets of conveyance adjuster patterns 61 in the scanning direction and align side by side along the scanning direction. The other two sets of the evenness adjuster patterns 62C, 62D among the four sets of the evenness adjuster patterns 62 are located on a rightward side of the four sets of the conveyance adjuster patterns 61 in the scanning direction and align side by side along the scanning direction.

In this arrangement, the area on the recordable sheet P, on which the four sets of evenness adjuster patterns 62 are recorded, is the area that faces the nozzles 10 in the inkjet head 12 when the recordable sheet P is in the condition shown in FIG. 8B. The evenness adjuster patterns 62A, 62B, 62C, 62D may be recorded by the inks in the colors of black, yellow, cyan, and magenta, respectively.

With the evenness adjuster patterns 62, based on differences in evenness, or unevenness, of the ink among the dots aligning along the conveying direction in each second plain part 82, amounts to discharge the ink from the nozzles 10 of the inkjet head 12 may be adjusted by, for example, adjusting driving waveforms to drive the inkjet head 12.

In the present embodiment, the first plain part 81 is located on the downstream side of the second plain part 82 in the conveying direction to align with the second plain part 82, and the nozzles 10 that are used to record the first plain part 81 are the same nozzles 10 as the nozzles 10 used to record a downstream end portion of the second plain part 82 in the conveying direction. Meanwhile, the third plain part 83 is located on the upstream side of the second plain part 82 in the conveying direction to align with the second plain part 82, and the nozzles 10 that are used to record the third plain part 83 are the same nozzles 10 as the nozzles 10 used to record an upstream end portion of the second plain part 82 in the conveying direction. Thus, each second plain part 82 has a portion, on each side in the conveying direction, which may be recorded by the nozzles 10 adjacent or close to the nozzles 10 used to record the first plain part 81 or the third plain part 83. Therefore, unevenness in the discharging performances of the nozzles 10 may be finely adjusted.

<Timing Adjuster Pattern>

Each timing adjuster pattern 63 includes a plurality of pattern pieces 90 as shown in FIG. 7C. The pattern pieces 90 align along the conveying direction and are displaced from one another in the conveying direction by a distance corresponding to rotation of the upper roller 13*a* at a rotation angle K2*a*.

Each pattern piece 90 has a first linear segment 91 and a second linear segment 92. The first linear segment 91 is a line extending in parallel with the conveying direction and is recorded in the ink discharged from the inkjet head 12 through the nozzles 10 while the carriage 11 is moving in one way, e.g., leftward. In each pattern piece 90 among the plurality of pattern pieces 90, the ink to record the first linear segment 91 is discharged at the same timing.

The second linear segment 92 is a line extending in parallel with the conveying direction and is recorded in the ink discharged from the inkjet head 12 through the nozzles 10 while the carriage 11 is moving in the other way, e.g., rightward. In each pattern piece 90 among the plurality of pattern pieces 90, the ink to record the second linear segment 92 is discharged at a different timing. Therefore, among the plurality of pattern pieces 90, timings to discharge the ink from the nozzles 10 to record the second linear segments 92 relative to the timing to discharge the ink from the nozzles 10 to record the first linear segments 91 is different. The first linear segment 91 and the second linear segment 92 may be recorded according to an arrangement such that, when the nozzles 10 and the recordable sheet P are spaced apart from each other by a predetermined distance, the first linear segment 91 and the second linear segment 92 overlap each other in one of the pattern pieces 90 located at a center in the conveying direction, as drawn in solid lines in FIG. 7C.

In this arrangement, when the nozzles 10 and the recordable sheet P are spaced apart from each other by a distance smaller than the predetermined distance, a time length since the nozzles 10 discharge the ink at the recordable sheet P until the discharged ink lands on the recordable sheet P may be shorter than a time length since the nozzles 10 discharge the ink at the recordable sheet P until the discharged ink lands on the recordable sheet P when the nozzles 10 and the recordable sheet P are spaced apart from each other by the predetermined distance. Therefore, the first linear segment 91 may be displaced rightward, and the second linear segment 92 may be displaced leftward. Therefore, as drawn in broken lines in FIG. 7C, the second linear segment 92 may be displaced leftward with respect to the second linear segment 92 drawn in the solid lines, and the first linear segment 91 and the second linear segment 92 overlap each other in one of the pattern pieces 90 located on an upstream side in the conveying direction from the one of the pattern pieces 90 located at the center in the conveying direction. Under this condition, the larger the difference between the predetermined distance and the distance between the nozzles 10 and the recordable sheet P is, in the farther upstream one of the pattern pieces 90 in the conveying direction the first linear segment 91 and the second linear segment 92 overlap each other.

On the other hand, when the nozzles 10 and the recordable sheet P are spaced apart from each other by a distance larger than the predetermined distance, a time length since the nozzles 10 discharge the ink at the recordable sheet P until the discharged ink lands on the recordable sheet P may be longer than the time length since the nozzles 10 discharge the ink at the recordable sheet P until the discharged ink lands on the recordable sheet P when the nozzles 10 and the recordable sheet P are spaced apart from each other by the predetermined distance. Therefore, the first linear segment 91 may be displaced leftward, and the second linear segment 92 may be displaced rightward. Therefore, as drawn in dash-and-dot lines in FIG. 7C, the second linear segment 92 may be displaced rightward with respect to the second linear segment 92 drawn in the solid lines, and the first linear segment 91 and the second linear segment 92 overlap each other in one of the pattern pieces 90 located on a downstream side in the conveying direction from the one of the pattern pieces 90 located at the center in the conveying direction. Under this condition, the larger the difference between the predetermined distance and the distance between the nozzles 10 and the recordable sheet P is, in the farther downstream one of the pattern pieces 90 in the conveying direction the first linear segment 91 and the second linear segment 92 overlap each other.

Thus, with the timing adjuster patterns 63, by observing the one of the pattern pieces 90 in which the first linear segment 91 and the second linear segment 92 overlap, the distance between the nozzles 10 and the recordable sheet P may be recognized. Therefore, based on the observation, discharging timings to discharge the ink when the carriage 11 is moved leftward along the scanning direction and when the carriage 11 is moved rightward along the scanning direction may be adjusted.

The plurality of timing adjuster patterns 63 include a plurality of timing adjuster patterns 63A, a plurality of timing adjuster patterns 63B, and a plurality of timing adjuster patterns 63C.

The plurality of timing adjuster patterns 63A are located between the conveyance adjuster patterns 61B and the conveyance adjuster pattern 61C in the conveying direction. The area on the recordable sheet P, in which the timing adjuster patterns 63A are recorded, is the area that faces the nozzles 10 in the inkjet head 12 when the recordable sheet P is in the condition shown in FIG. 8B. The plurality of timing adjuster patterns 63 are arranged substantially throughout an entire length of the recordable sheet P in the scanning direction. Thus, the discharging timings to discharge the ink from the nozzles 10 when the recordable sheet P is in the condition shown in FIG. 8B may be correctly adjusted.

The plurality of timing adjuster patterns 63B are arranged on a downstream side of the plurality of timing adjuster patterns 63A in the conveying direction and side by side on each side of the conveyance adjuster pattern 61C in the scanning direction to align along the scanning direction. The area on the recordable sheet P, in which the timing adjuster patterns 63B are recorded, is the area that faces the nozzles 10 in the inkjet head 12 when the recordable sheet P is in the condition shown in FIG. 8C.

The plurality of timing adjuster patterns 63C are arranged on a downstream side of the plurality of timing adjuster patterns 63B in the conveying direction and side by side on each side of the conveyance adjuster pattern 61C in the scanning direction to align along the scanning direction. The area on the recordable sheet P, in which the timing adjuster patterns 63C are recorded, is the area that faces the nozzles 10 in the inkjet head 12 when the recordable sheet P is in the condition shown in FIG. 8D.

Neither the timing adjuster patterns 63B nor the timing adjuster patterns 63C is arranged at a central area in the scanning direction on the recordable sheet P. However, based on a difference between recorded outcome of the timing adjuster patterns 63B, 63C and a recorded outcome of the timing adjuster patterns 63A at the same positions in the scanning direction, the discharging timings to discharge the ink from the nozzles 10 while the carriage 11 is moved throughout the entire length along the scanning direction leftward and rightward when the recordable sheet P is in the conditions shown in FIGS. 8C and 8D and may be correctly adjusted.

<Processes to Adjust Settings in the Recorder>

Next, a flow of processes to adjust the settings in the recorder 2, including amounts to convey the recordable sheet P, amounts to discharge the ink through the nozzles 10, and timings to discharge the ink from the nozzles 10 in recording passes, will be described below. The controller 50 may conduct the processes according to the flow shown in FIG. 9 to adjust the settings. For example, a program containing instructions to cause the controller 50 to conduct the processes shown in FIG. 9 may be stored in the ROM 52.

According to the flow shown in FIG. 9, in S101, the controller 50 controls the carriage motor 56, the inkjet head 12, the conveyer motor 57, and the feeder 3 in the recorder 2 to record the test patterns 60 as shown in FIG. 6 on the recordable sheet P. Detailed procedures to record the test patterns 60 on the recordable sheet P will be described further below.

After the test patterns 60 are recorded on the recordable sheet P, in S102, the controller 50 controls the display 6 to display a message advising a user to set the recordable sheet P with the recorded test patterns 60 thereon on the reader 5. Moreover, the controller 50 controls the display 6 to display a message instructing the user to perform a predetermined operation through the operation interface 7 after setting the recordable sheet P on the reader 5.

In S103, the controller 50 awaits until a set-completion signal, which indicates that setting the recordable sheet P with the test patterns 60 recorded thereon is completed, is input in accordance with the user's predetermined operation through the operation interface 7 (S103: NO). When the set-completion signal is input (S103: YES), in S104, the controller 50 controls the reader 5 to read the test patterns 60, including the conveyance adjuster patterns 61, the evenness adjuster pattern 62, and the timing adjuster pattern 63, recorded on the recordable sheet P set on the reader 5. The reader 5 may thereafter receive an adjuster signal issued based on the outcome of reading the test patterns 60.

In S105, based on the outcome of reading the conveyance adjuster patterns 61 indicated in the adjuster signal received from the reader 5 in S104, the controller 50 adjusts amounts to convey the recordable sheet P, i.e., rotation angles of the upper roller 13*a*, for each of the conditions of the recordable sheet P as shown in FIGS. 8A-8D.

In S106, based on the outcome of reading the evenness adjuster patterns 62 indicated in the adjuster signal received from the reader 5 in S104, the controller 50 adjusts the amounts of the ink to be discharged from the nozzles 10 in the inkjet head 12 by, for example, adjusting the driving waveforms to drive the inkjet head 12.

In S107, based on the outcome of reading the timing adjuster patterns 63 indicated in the adjuster signal received from the reader 5 in S104, the controller 50 adjusts the discharging timings to discharge the ink from the nozzles 10 while the carriage 11 is moved leftward and rightward along the scanning direction.

Optionally, the processes in S105-S107 may be conducted in a different order from the order shown in FIG. 9 or may be conducted simultaneously in parallel with one another.

<Procedure for Recording Test Patterns>

Next, a procedure to record the test patterns 60 with the recorder 2 will be described below. When the recorder 2 records the test patterns 60, first, the two conveyance adjuster patterns 61A may be recorded. Thereafter, the four conveyance adjuster patterns 61B and the four evenness adjuster patterns 62A-62D may be recorded. Thereafter, the plurality of timing adjuster patterns 63A may be recorded. Thereafter, the two conveyance adjuster patterns 61C and the plurality of timing adjuster patterns 63B may be recorded. Thereafter, finally, the two conveyance adjuster patterns 61D and the plurality of timing adjuster patterns 63C may be recorded.

<Recording Conveyance Adjuster Patterns 61A>

For recording the two conveyance adjuster patterns 61A, first, as shown in FIG. 10, the first pattern piece 71 for one of the conveyance adjuster patterns 61A on the downstream side in the conveying direction may be recorded in an Na-th recording pass. The sign Na represents an integer equal to or greater than one (1) (e.g., Na=1). The Na-th recording pass may mean an Na-th (e.g., first) recording row, counting from the beginning of the entire recording of the test patterns 60, and an (Na+1)th recording pass may mean an (Na+1)th (e.g., second) recording row, and so on. In the following description, signs Nb, Nc, Nd . . . , etc., will be used in the same manner. Meanwhile, a range R shown in FIGS. 10-13 shows a range, in which the inkjet head 12 may record dots in a single recording pass.

Next, the controller 50 controls the conveyer roller 13 and the ejection roller 16 to perform a conveying action, in which the recordable sheet P is conveyed by the conveyer roller 13 and/or the ejection roller 16 by an amount corresponding to rotation of the upper roller 13*a* at the rotation angle K1*a*, by controlling the conveyer motor 57 based on the signals from the rotary encoder 58. In the following paragraphs, the conveying action, in which the conveyer roller 13 and/or the ejection roller 16 convey the recordable sheet P by an amount corresponding to rotation of the upper roller 13*a* at a rotation angle such as K1*a*, may be described in a simplified expression such as a "conveying action at the rotation angle K1*a*," and the act of the controller 50 to control the conveyer roller 13 and the ejection roller 16 to perform the conveying action may be described in an expression as "the controller 50 conducts the conveying action."

After the conveying action at the rotation angle K1*a*, the controller 50 conducts the (Na+1)th recording pass to record the second pattern piece 72 for the one of conveyance adjuster patterns 91A on the downstream side in the conveying direction. Thus, the conveyance adjuster pattern 61A on the downstream side in the conveying direction between the two conveyance adjuster patterns 61A may be completely recorded.

The controller 50 next conducts a conveying action at a rotation angle K1*b*. Thereafter, the controller 50 conducts an (Na+2)th recording pass to record the first pattern piece 71 for the other of the conveyance adjuster patterns 61A on the upstream side in the conveying direction.

The controller 50 next conducts a conveying action at the rotation angle K1*a*. Thereafter, the controller 50 may conduct an (Na+3)th recording pass to record the second pattern piece 72 for the conveyance adjuster pattern 61A on the upstream side in the conveying direction. Thus, the two conveyance adjuster patterns 61A are completely recorded.

<Recording Conveyance Adjuster Patterns 61B and Evenness Adjuster Pattern 62>

Next, a procedure to record the four conveyance adjuster patterns 61B and the four evenness adjuster patterns 62 will be described below. The controller 50, after recording the two conveyance adjuster patterns 61 in the process as described above, conducts a conveying action to convey the recordable sheet P to a starting position, in which recording of the four conveyance adjuster patterns 61B and the four evenness adjuster patterns 62 starts. From the starting position, as shown in FIG. 11, the controller 50 conducts an Nb-th recording pass to record the first plain parts 81 for the bar pieces 80 on the downstream side among the three bar pieces 80 aligning in each evenness adjuster pattern 62 in the conveying direction. The sign Nb represents an integer equal to or greater than (Na+4), e.g., Nb=(Na+4).

Next, the controller 50 conducts a conveying action at a rotation angle K2*a* and thereafter an (Nb+1)th recording pass to record the second plain parts 82 for the bar pieces 80 on the downstream side among the three bar pieces 80 in each evenness adjuster pattern 62 in the conveying direction. The rotation angle K2*a* is a rotation angle for the upper roller 13*a* to rotate to convey the recordable sheet P by a length equal to the first plain part 81 in the conveying direction and is smaller than the rotation angle K1*a*.

Thereafter, the controller 50 conducts a conveying action at the rotation angle K2*a* and an (Nb+2)th recording pass to record the third plain parts 83 for the bar pieces 80 on the downstream side among the three bar pieces 80 in each evenness adjuster pattern 62 in the conveying direction. Thus, the bar pieces 80 on the downstream side among the three bar pieces 80 in the conveying direction are completely recorded. Moreover, in the (Nb+2)th recording pass, the first pattern piece 71 for one of the conveyance adjuster patterns 61B most downstream among the four conveyance adjuster patterns 61B in the conveying direction is recorded between the bar piece 80 in the evenness adjuster pattern 62B and bar piece 80 in the evenness adjuster pattern 62C.

Next, the controller 50 conducts a conveying action at the rotation angle K1*a* and thereafter an (Nb+3)th recording pass to record the second pattern piece 72 for the one of the conveyance adjuster patterns 61B most downstream among the four conveyance adjuster patterns 61B in the conveying direction. Thus, by performing the (Nb+2)th recording pass, the conveying action at the rotation angle K1*a*, and the (Nb+3)th recording pass continuously, the conveyance adjuster pattern 61B at the most downstream position in the conveying direction may be completely recorded. Moreover, in the (Nb+3) recording pass, the first pattern piece 71 for another one of the conveyance adjuster patterns 61B at the second downstream position in the conveying direction is recorded.

Next, the controller 50 conducts a conveying action at the rotation angle K1*a* and thereafter an (Nb+4)th recording pass to record the second pattern piece 72 for the one of the conveyance adjuster patterns 61B at the second downstream position in the conveying direction. Thus, the conveyance adjuster pattern 61B at the second downstream position in the conveying direction is completely recorded.

Next, the controller 50 conducts a conveying action at a rotation angle (K2*b*−2*K1*a*) and thereafter conduct an (Nb+5)th recording pass to record the first plain parts 81 for the bar pieces 80 at the center among the three bar pieces 80 in each evenness adjuster pattern 62 in the conveying direction.

Thus, after recording the third plain parts 83 for the bar pieces 80 on the downstream side in the conveying direction in the (Nb+2)th recording pass, and before recording the first plain parts 81 in the bar pieces 80 at the center in the conveying direction in the (Nb+5)th recording pass, the recordable sheet P may need to be conveyed by an amount equal to the amount conveyed by a conveying action at a rotation angle K2*b*. In this embodiment, the rotation angle K2*b* is a rotation angle to rotate the upper roller 13*a* to convey the recordable sheet P in the conveying direction by an amount equal to the length of the nozzle arrays 9 in the conveying direction.

In other words, in the present embodiment, two (2) conveying actions at the rotation angle K1*a* and one (1) conveying action at the rotation angle (K2*b*−2*K1*a*) are conducted in place of the conveying actinon at the rotation angle K2*b*. In other words, the conveying action at the rotation angle K2*b* may be divided into three (3) conveying actions: two (2) conveying actions at the rotation angle K1*a* and one (1) conveying action at the rotation angle (K2*b*−2*K1*a*).

Thereafter, (Nb+6)th through (Nb+9)th recording passes are conducted in a procedure similar to the (Nb+1)th through the (Nb+4)th recording passes described above to record the second plain parts 82 and the third plain parts 83 for the bar pieces 80 at the center in the conveying direction and the first pattern pieces 71 and the second pattern pieces 72 in the conveyance adjuster patterns 61 at the third and fourth downstream positions in the conveying direction.

Moreover, although not shown in the drawings, after the (Nb+9)th recording pass, the controller 50 may conduct a conveying action at the rotation angle K2*b* and (Nb+10)th through (Nb+12)th recording passes similarly to the Nb-th through (Nb+2)th recording passes to record the first plain parts 81, the second plain parts 82, and the third plain parts 83 for the bar pieces 80 on the upstream side in the conveying direction.

<Recording Timing Adjuster Patterns 63A>

Next, a procedure to record the plurality of timing adjuster patterns 63A will be described below. The controller 50, after recording the four conveyance adjuster patterns 61 and the four evenness adjuster patterns 62 in the process as described above, conducts a conveying action to convey the recordable sheet P to a starting position, in which recording of the plurality of timing adjuster patterns 63A starts.

From the starting position, as shown in FIG. 12, the controller 50 conducts Nc-th and (Nc+1)th recording passes to record the first linear segments 91 and the second linear segments 92 for the pattern pieces 90 at the most downstream position in the conveying direction in the plurality of timing adjuster patterns 63A. The sign Nc represents an integer equal to or greater than (Nb+13), e.g., Nc=(Nb+13). In particular, the Nc-th recording pass is a recording pass, in which the carriage 11 is moved one way, e.g., leftward, and in which the first linear segments 91 for the pattern pieces 90 at the most downstream position in the conveying direction are recorded. The (Nd+1)th recording pass is a recording pass, in which the carriage 11 is moved the other way, e.g., rightward, and the second linear segments 92 for the pattern pieces 90 at the most downstream position in the conveying direction are recorded. After the Nc-th recording pass and before the (Nc+1)th recording pass, no conveying action is conducted.

After the (N+1)th recording pass, the controller 50 conducts a conveying action at a rotation angle K3*a* and thereafter (Nc+2) and (Nc+3) recording passes continuously to record the pattern pieces 90 at the second downstream position in the conveying direction. The rotation angle K3*a* is a rotation angle to rotate the upper roller 13*a* to convey the recordable sheet P in the conveying direction by an amount equal to the length of the pattern parts 90 in the conveying direction. Meanwhile, the rotation angle K1*a* mentioned above is four times as great as the rotation angle K3*a*.

The controller 50 conducts (Nc+2)-th and (Nc+3)-th recording passes and onwards in the same manner as the Nc and (Nc+1) recording passes. In other words, within two (2) continuous recording passes, in an earlier recording pass, the first linear segments 91 are recorded, and a later recording pass, the second linear segments 92 are recorded.

The controller 50 repeats the conveying action at the rotation angle K3*a* and two continuous recording passes, i.e., (Nc+4)th and (Nc+5)th, (Nc+6)th and (Nc+7)th, . . . (Nc+20)th and (Nc+21)th recording passes alternately to record the pattern pieces 90. Thus, the plurality of timing adjuster patterns 63A are recorded.

<Recording Conveyance Adjuster Patterns 61C and Timing Adjuster Patterns 63B>

Next, a procedure to record the two conveyance adjuster patterns 61C and the plurality of timing adjuster patterns 63B will be described below. The controller 50 may, after recording the plurality of timing adjuster patterns 63A in the process as described above, conduct a conveying action to convey the recordable sheet P to a starting position, in which recording of the two conveyance adjuster patterns 61C and the plurality of timing adjuster patterns 63B starts.

From the starting position, as shown in FIG. 13, the controller 50 conducts Nd-th and (Nd+1)th recording passes to record the first linear segments 91 and the second linear segments 92 for the pattern pieces 90 at the most downstream position in the conveying direction in the plurality of timing adjuster patterns 63B and the first pattern piece 71 for one of the two conveyance adjuster patterns 61C on the downstream side in the conveying direction. The sign Nd represents an integer equal to or greater than (Nc+22), e.g., Nd=(Nc+22).

The first linear segments 91 and the second linear segments 92 in the timing adjuster patterns 63B may be recorded in a process similar to the process to record the first linear segments 91 and the second linear segments 92 in the timing adjuster patterns 63A described above. Moreover, in either in the Nd-th or the (Nd+1)th recording pass, the first pattern piece 71 is recorded.

Thereafter, the controller 50 repeats the conveying action at the rotation angle K3*a* and two continuous recording passes, i.e., (Nd+2)th and (Nd+3)th, (Nd+4)th and (Nd+5)th, . . . (Nd+20)th and (Nd+21)th recording passes alternately to record the pattern pieces 90 for the timing adjuster patterns 63B in the same manner as the process to record the plurality of timing adjuster patterns 63A.

Meanwhile, after recording the first pattern piece 71 for the one of the conveyance adjuster patterns 61C on the downstream side in the conveying direction in either the Nd-th or the (Nd+1)th recording pass, in either the (Nd+8)th or the (Nd+9)th recording pass, which is a recording pass after conducting the conveying action at the rotation angle K3*a* for four (4) times, the controller 50 records the second pattern piece 72 for the one of the two conveyance adjuster patterns 61C on the downstream side in the conveying direction together with the pattern pieces 90 for the timing adjuster patterns 63B.

Further, after recording the second pattern piece 72 in either the (Nd+8)th or the (Nd+9)th recording pass, in either the (Nd+12)th or the (Nd+13)th recording pass, which is a recording pass after conducting the conveying action at the rotation angle K3*a* twice, the controller 50 records the first pattern piece 71 for the other one of the two conveyance adjuster patterns 61C on the upstream side in the conveying direction together with the pattern pieces 90 for the timing adjuster patterns 63B.

Further, after recording the first pattern piece 71 in either the (Nd+12)th or the (Nd+13)th recording pass, in either (Nd+20) or (Nd+21) recording pass, which is a recording pass after conducting the conveying action at the rotation angle K3*a* for four (4) times, the controller 50 records the second pattern piece 72 for the other one of the two conveyance adjuster patterns 61C on the upstream side in the conveying direction together with the pattern pieces 90 for the timing adjuster patterns 63B.

Thus, for each of the two conveyance adjuster patterns 61C, the second pattern piece 72 may be recorded on the recordable sheet P at the position displaced downstream from the position of the first pattern piece 71 by an amount accumulated in the four conveying actions at the rotation angle K3*a*, in other words, an amount substantially equal to the conveyance amount by a single conveying action at the rotation angle K1*a*.

Moreover, after recording the second pattern piece 72 for the conveyance adjuster pattern 61C on the downstream side in the conveying direction, and before recording the first pattern piece 71 for the conveyance adjuster pattern 61C on the upstream side in the conveying direction, the conveying action for recording the timing adjuster patterns 63B may be conducted twice.

<Recording Conveyance Adjuster Patterns 61D and Timing Adjuster Patterns 63C>

Next, a procedure to record the two conveyance adjuster patterns 61D and the plurality of timing adjuster patterns 63C will be described below. The controller 50, after recording the two conveyance adjuster patterns 61C and the plurality of timing adjuster patterns 63B in the process as described above, conducts a conveying action to convey the recordable sheet P to a starting position, in which recording of the two conveyance adjuster patterns 61D and the plurality of timing adjuster patterns 63C starts. From the starting position, in the same procedure as the procedure to record the two conveyance adjuster patterns 61C and the plurality of timing adjuster patterns 63B, the controller 50 records the two conveyance adjuster patterns 61D and the plurality of timing adjuster patterns 63C.

Thus, for some of the pattern pieces 90 in the timing adjuster patterns 63B, the first linear segments 91 or the second linear segments 92 may be recorded in the same recording pass as the first pattern pieces 71 for the conveyance adjuster patterns 61C, and in some of the pattern pieces 90 for the timing adjuster patterns 63C, the first linear segments 91 or the second linear segments 92 may be recorded in the same recording pass as the first pattern pieces 71 for the conveyance adjuster patterns 61D.

Moreover, for some of the pattern pieces 90 in the timing adjuster patterns 63B, the first linear segments 91 or the second linear segments 92 may be recorded in the same recording pass as the second pattern pieces 72 for the conveyance adjuster patterns 61C, and for some of the pattern pieces 90 in the timing adjuster patterns 63C, the first linear segments 91 or the second linear segments 92 may be recorded in the same recording pass as the second pattern pieces 72 for the conveyance adjuster patterns 61D.

<Benefits>

According to the embodiment described above, after recording the second pattern piece 72 for the one of the conveyance adjuster patterns 61B at the second downstream position in the conveying direction, and before recording the first pattern piece 71 for another one of the conveyance adjuster patterns 61B at the third downstream position in the conveying direction, the conveyance action for recording the evenness adjuster patterns 62 may be conducted; thereby, the four conveyance adjuster patterns and the four evenness adjuster patterns 62 may be recorded side by side along the scanning direction.

Moreover, after recording the second pattern piece 72 for the one of the conveyance adjuster patterns 61C on the downstream side in the conveying direction, and before recording the first pattern piece 71 for the other one of the conveyance adjuster patterns 61C on the upstream side in the conveying direction, the conveying action for recording the timing adjuster patterns 63B may be conducted; thereby, the two conveyance adjuster patterns 61C and the timing adjuster patterns 63B may be recorded side by side along the scanning direction.

Similarly, after recording the second pattern piece 72 for the one of the conveyance adjuster patterns 61D on the downstream side in the conveying direction, and before recording the first pattern piece 71 for the other one of the conveyance adjuster patterns 61D on the upstream side in the conveying direction, the conveying action for recording the timing adjuster patterns 63C may be conducted; thereby, the two conveyance adjuster patterns 61D and the timing adjuster patterns 63C may be recorded side by side along the scanning direction.

Meanwhile, between the conveying actions for recording the evenness adjuster patterns 62 and the conveying actions for recording the timing adjuster patterns 63B, 63C, amounts to convey the recordable sheet P, i.e., the rotation angles of the upper roller 13*a*, are different. Therefore, among the distances between two adjoining ones of the ten (10) conveyance adjuster patterns 61 in the conveying direction, at least a distance T1 between the one of the conveyance adjuster patterns 61B at the second downstream position and the one of the conveyance adjuster patterns 61B at the third downstream position to be recorded next, and a distance T2 between the ones of the conveyance adjuster patterns 61C, 61D on the downstream side and the other ones of the conveyance adjuster patterns 61C, 61D on the upstream side to be recorded next are different.

While at least the distance T1 and the distance T2 within the ten conveyance adjuster patterns 61 are different, the evenness adjuster patterns 62 and the timing adjuster patterns 63, which are functionally different patterns from the conveyance adjuster patterns 61, and of which the amounts to convey the recordable sheet Pin the conveying actions for recording are different, may be recorded side by side with the conveyance adjuster patterns 61 in the scanning direction.

Moreover, in the present embodiment, the reader 5 may read the recorded test patterns 60, and based on adjuster signals received from the reader 5, settings concerning amounts to convey the recordable sheet P, amounts to discharge the ink from the nozzles 10, and timings to discharge the ink from the nozzles 10 in recording passes may be adjusted.

In the present embodiment, the amount for the recordable sheet P to be conveyed between recording of the first pattern piece 71 and recording of the second pattern piece 72 for one of the conveyance adjuster patterns 61, i.e., the rotation angle K1*a*, is four times as great as the amount, i.e., the rotation angle K3*a*, to convey the recordable sheet Pin the conveying action to record the timing adjuster patterns 63. In this regard, for recording the conveyance adjuster patterns 61C and the timing adjuster patterns 63B side by side in the scanning direction and the conveyance adjuster patterns 61D and the timing adjuster patterns 63C side by side in the scanning direction, either the first linear segments 91 or the second linear segments 92 for the pattern pieces 90 and the first pattern piece 71 are recorded in a single recording pass, and thereafter, in a recording pass after conducting the conveying at the rotation angle K3*a* for four times, either the first linear segments 91 of the second linear segments 92 for the pattern pieces 90 and the second pattern piece 72 are recorded. Thereby, the first pattern pieces 71 and the second pattern pieces 72 for the conveyance adjuster patterns 61C, 61D may be desirably recorded.

Moreover, for recording the evenness adjuster patterns 62, after recording the third plain parts 83 for the bar pieces 80, and before recording the first plain parts 81 for another bar pieces 80, which adjoin on the upstream side in the conveying direction, the recordable sheet P may be conveyed in the conveying action at the rotation angle K2*b*, which is greater than the rotation angle K1*a*.

Therefore, in the present embodiment, in place of the conveying action at the rotation angle K2*b*, two conveying actions at the rotation angle K1*a* and a single conveying action at the rotation angle (K2*b*−2*K1*a*) may be conducted. Meanwhile, before and after each of the conveying actions at the rotation angle K1*a*, the first pattern piece 71 and the second pattern piece 72 for the conveyance adjuster pattern 61B may be recorded, respectively. Thereby, the first pattern pieces 71 and the second pattern pieces 72 for the conveyance adjuster patterns 61B may be desirably recorded.

Meanwhile, after recording the first pattern piece 71, the recordable sheet P may be conveyed in the single conveying action at the rotation angle K1*a*, and the second pattern piece 72 may be recorded thereafter. In this arrangement, amounts to convey the recordable sheet P may be adjusted finely based on the recorded outcome of the conveyance adjuster patterns 61B read by the reader 5.

In the present embodiment, moreover, each evenness adjuster pattern 62 contains the bar pieces 80, each of which containing the first plain part 81, the second plain part 82, and the third plain part 83 continuously aligning in the conveying direction. In particular, the first plain part 81 and the third plain part 83 are located on the downstream side and the upstream side, respectively, of the second plain part 82 in the conveying direction. The nozzles 10 to be used to record the first plain part 81 are the same nozzles 10 as the nozzles 10 to be used to record the downstream end portion of the second plain part 82 in the conveying direction, and the nozzles 10 to be used to record the third plain part 81 are the same nozzles 10 as the nozzles 10 to be used to record the upstream end portion of the second plain part 82 in the conveying direction. In this arrangement, based on the recorded outcome of the evenness adjuster patterns 62 read by the reader 5, the evenness of the ink in each position in the second plain part 82 may be correctly obtained.

More Examples

Although an example of carrying out the invention has been described, those skilled in the art will appreciate that there are numerous variations and permutations of the liquid discharging apparatus, the liquid discharging system, the pattern recording method, and the computer-readable storage medium storing the computer readable instructions to cause the liquid discharging apparatus to record the patterns that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters. Below will be described modified examples of the present embodiment.

For example, in the embodiment described above, the evenness adjuster patterns 62 or the timing adjuster patterns 63 are recorded along with the conveyance adjuster patterns 61 on the same sheet; however, patterns to be recorded along with the conveyance adjuster patterns 61 on the same recordable sheet P may not necessarily be limited to the evenness adjuster patterns 62 or the timing adjuster patterns 63. A first example modified from the embodiment will be described below.

As shown in FIG. 14A, the test patterns may include the two conveyance adjuster patterns 61D and two (2) margin adjuster patterns 101. The two conveyance adjuster patterns 61D may be similar to the conveyance adjuster patterns 61 in the embodiment described above and align spaced apart from each other along the conveying direction. The margin adjuster patterns 101 may be arranged on a leftward side and a rightward side in the scanning direction to align side by side with the conveyance adjuster patterns 61D in the scanning direction on recordable sheet P. Each margin adjuster pattern 101 includes pattern pieces 102 103. The pattern pieces 102, 103 may be rectangular plain color-filled patterns. The pattern piece 103 is arranged downstream to be spaced apart from the pattern piece 102 in the conveying direction. The pattern piece 103 may be recorded on the recordable sheet P at a position having been conveyed from a previous position, at which the pattern piece 102 was recorded, by an amount in the conveying direction equal to a conveying action at a rotation angle of K4*a*. The rotation angle K4*a* is greater than the rotation angle K1*a*.

A procedure to record the two conveyance adjuster patterns 61D and the two margin adjuster patterns 101 in the first modified example will be described below. For recording the two conveyance adjuster patterns 61D and the two margin adjuster patterns 101, first, the controller 50 may conduct an Ne-th recording pass, as shown in FIG. 14B, to record the first pattern piece 71 for one of the conveyance adjuster patterns 61D on the downstream side in the conveying direction and the pattern pieces 102 for the two margin adjuster patterns 101. The sign Ne represents an integer equal to or greater than one (1) (e.g., Ne=1).

Next, the controller 50 may conduct a conveying action at the rotation angle K1*a* and thereafter an (Ne+1)th recording pass to record the second pattern piece 72 for the one of the conveyance adjuster patterns 61D on the downstream side in the conveying direction.

Next, the controller 50 may conduct a conveying action at a rotation angle (K4*a*-K1*a*) and thereafter an (Ne+2)th recording pass to record the first pattern piece 71 for the other one of the conveyance adjuster patterns 61D on the upstream side in the conveying direction and the pattern pieces 103 for the two margin adjuster patterns 101. In the (Ne+2)th recording pass, the controller 50 may control the carriage 11 to move at a moving speed different from a moving speed of the carriage 11 in the Ne-th recording pass.

Further, the controller 50 may conduct a conveying action at the rotation angle K1*a* and thereafter an (Ne+3)th recording pass to record the second pattern piece 72 for the other one of the conveyance adjuster patterns 61D on the upstream side in the conveying direction.

With the margin adjuster patterns 101 recorded as above, based on a difference between a distance D1, which is between the pattern piece 102 on the left and a leftward edge of the recordable sheet P, and a distance D2, which is between the pattern piece 102 on the right and a rightward edge of the recordable sheet P, and a difference between a distance D3, which is between the pattern piece 103 on the left and the leftward edge of the recordable sheet P, and a distance D4, which is between the pattern piece 103 on the right and the rightward edge of the recordable sheet P, a difference between margins on the left and right in the recordable sheet P may be obtained. Based on the obtained difference, the timings to discharge the ink from the nozzles 10 may be adjusted, and thereby the amounts of the margins in the scanning direction on the left and the right may be adjusted.

A second modified example of the embodiment of the present disclosure will be described below. As shown in FIG. 15A, the test patterns may include two (2) conveyance adjuster patterns 61E and two (2) registration adjuster patterns 111. The two conveyance adjuster patterns 61E may be similar to the conveyance adjuster patterns 61 in the embodiment described above and align spaced apart from each other along the conveying direction. The registration adjuster patterns 111 may be arranged in an end area of the recordable sheet P on an upstream side in the conveying direction to align side by side with the conveyance adjuster patterns 61E in the scanning direction. Each registration adjuster pattern 111 includes pattern pieces 112 113. The pattern pieces 112, 113 may be rectangular plain color-filled patterns. The pattern piece 113, in particular, a downstream end portion of the pattern piece 113, overlaps an upstream end portion of the pattern piece 112, in the conveying direction. The pattern piece 113 may be recorded on the recordable sheet P at a position having been conveyed from a previous position, at which the pattern piece 112 was recorded, by an amount in the conveying direction equal to a conveying action at a rotation angle of K5*a*. The rotation angle K5*a* is greater than the rotation angle K1*a*.

A procedure to record the two conveyance adjuster patterns 61E and the two registration adjuster patterns 111 in the second modified example will be described below. For recording the two conveyance adjuster patterns 61E and the two registration adjuster patterns 111, first, the controller 50 may conduct an Nf-th recording pass, as shown in FIG. 15B, to record the first pattern piece 71 for one of the conveyance adjuster patterns 61E on the downstream side in the conveying direction and the pattern pieces 112 for the two registration adjuster patterns 111. The sign Nf represents an integer equal to or greater than one (1).

Next, the controller 50 may conduct a conveying action at the rotation angle K1*a* and thereafter an (Nf+1)th recording pass to record the second pattern piece 72 for the one of the conveyance adjuster patterns 61E on the downstream side in the conveying direction.

Next, the controller 50 may conduct a conveying action at a rotation angle (K5*a*-K1*a*) and thereafter an (Nf+2)th recording pass to record the first pattern piece 71 for the other one of the conveyance adjuster patterns 61E on the upstream side in the conveying direction and the pattern pieces 113 for the two registration adjuster patterns 111.

Further, the controller 50 may conduct a conveying action at the rotation angle Kia and thereafter an (Nf+3) recording pass to record the second pattern piece 72 for the other one of the conveyance adjuster patterns 61E on the upstream side in the conveying direction.

With the registration adjuster patterns 111 recorded as above, based on a difference between a distance E1, which is between the registration adjuster pattern 111 on the left and an edge of the recordable sheet P on the upstream side in the conveying direction, and a distance E2, which is between the registration adjuster pattern 111 on the right and the edge of the recordable sheet P on the upstream side in the conveying direction, information concerning skewing of the recordable sheet P with respect to the conveying direction may be obtained. Based on the obtained information, devices and/or parts in, for example, the feeder 3 may be adjusted, and the skewing of the recordable sheet P being conveyed may be corrected.

Optionally, the conveyance adjuster patterns 61D and the margin adjuster patterns 101 in the first modified example described earlier and the conveyance adjuster patterns 61E and the registration adjuster patterns 111 in the second modified example described above may be recorded on the same recordable sheet P along with the conveyance adjuster patterns 61B and the evenness adjuster patterns 62; the conveyance adjuster patterns 61C and the timing adjuster patterns 63B; and the conveyance adjuster patterns 61D and the timing adjuster patterns 63C. Moreover, the conveyance adjuster patterns 61D and the margin adjuster patterns 101 in the first modified example described earlier and/or the conveyance adjuster patterns 61E and the registration adjuster patterns 111 in the second modified example described above may be recorded on the same recordable sheet P along with at least one of the conveyance adjuster patterns 61B and the evenness adjuster patterns 62; the conveyance adjuster patterns 61C and the timing adjuster patterns 63B; and the conveyance adjuster patterns 61D and the timing adjuster patterns 63C.

For another example, the recordable sheet P may not necessarily be shaped into the corrugated form waving up and down along the scanning direction by the pressers 14*a* in the corrugating plate 14, the ribs 20, and the corrugating spur wheels 17. For example, on an upper surface of the platen 15, vacuuming inlets to pull the recordable sheet P toward the platen 15 may be arranged at positions between adjoining ribs 20 along the scanning direction in place of the corrugating plates 14 and the corrugating spur wheels 17. In this arrangement, the recordable sheet P may be deformed into the corrugated form waving up and down along the scanning direction by being vacuumed at the vacuuming inlets.

For another example, the rotation angle K1*a* may not necessarily be four times as large as the rotation angle K3*a* but may be, for example, twice, three times, or five times as large as the rotation angle K3*a* or may be a multiple of the rotation angle K3*a* by any integer.

For another example, patterns that are different from the timing adjuster patterns 63 and that may be recorded with a conveying action, in which the upper roller 13*a* may be rotated at a rotation angle being an integral multiple of the rotation angle K1*a*, may be recorded side by side with the conveyance adjuster patterns 61 along the scanning direction.

For another example, the conveyance adjuster patterns 61 may not necessarily be recorded along with the two different-typed adjuster patterns, e.g., the evenness adjuster patterns 62 and the timing adjuster patterns 63, on the same recordable sheet P. In other words, the conveyance adjuster patterns 61 may be recorded along with solely one of the evenness adjuster patterns 62 and the timing adjuster patterns 63 on the same recordable sheet P. For another example, the conveyance adjuster patterns 61 may be recorded along with three or more different-typed adjuster patterns on the same recordable sheet P.

For another example, the conveying actions for recording the evenness adjuster patterns 62 may not necessarily include the conveying action, in which the amount to convey the recordable sheet P is smaller than the amount to convey the recordable sheet P in the conveying action for recording the conveyance adjuster patterns 61, and the conveying action, in which the amount to convey the recordable sheet P is greater than the amount to convey the recordable sheet P in the conveying action for recording the conveyance adjuster patterns 61. In other words, the conveying actions for recording the evenness adjuster patterns 62 may include the conveying action, in which the amount to convey the recordable sheet P is smaller than the amount to convey the recordable sheet P in the conveying action for recording the conveyance adjuster patterns 61, and a conveying action, in which the amount to convey the recordable sheet P is equal to the amount to convey the record able sheet P in the conveying action for recording the conveyance adjuster patterns 61. In this arrangement, optionally, the first pattern pieces 71 and the second pattern pieces 72 for the conveyance adjuster patterns 61 may be recorded before and after the latter conveying action, in which the amount to convey the recordable sheet P is equal to the amount to convey the record able sheet P in the conveying action for recording the conveyance adjuster patterns 61, respectively.

For another example, the settings in the recorder 2 may not necessarily be adjusted by the controller 50 in the inkjet printer 1 based on the adjustment signals received from the reader 5 reading the test patterns 60. In the following paragraphs, a third modified example of the embodiment according to the present disclosure will be described.

In the third modified example, as shown in FIG. 16A, a recording system 120 includes an inkjet printer 121 and a PC 122. The inkjet printer 121 may be similar to the inkjet printer 1 in the embodiment described above. The PC 122 is connected with the inkjet printer 121 and includes a display 123 and an operation interface 124. The display 123 may be, for example, a liquid crystal display, and the operation interface 124 may include, for example, a mouse and a keyboard.

When a user instructs the inkjet printer 121 to adjust the settings in the inkjet printer 121 through the operation interface 124, a flow of processes shown in FIG. 16B may start. As the flow starts, in S201, the PC 122 may transmit a pattern-record command signal to command the inkjet printer 121 to record the test patterns 60 to the inkjet printer 121.

The inkjet printer 121 receiving the pattern-record command signal from the PC 122 may start a flow of processes shown in FIG. 16C. As the flow starts, in S301, the inkjet printer 121 may record the test patterns 60 on the recordable sheet P. Next, in S302, the inkjet printer 121 may transmit a message-display signal to the PC 122. The message-display signal may cause the PC 122 to display a message advising the user to set the recordable sheet P, on which the test patterns are recorded, on the reader 5 (see FIG. 1).

Meanwhile, the PC 122 may, after transmitting the pattern-record command signal in S201, in S202, await until the message-display signal from the inkjet printer 121 is received (S202: NO). When the message-display signal is received (S202: YES), in S203, the PC 122 may control the display 123 to display the message according to the received message-display signal. In S204, the PC 122 may await until a set-completion signal, entered by the user through the operation interface 124 and indicating that the user has set the recordable sheet P on the reader 5, is received (S204: NO). When the set-completion signal is received (S204: YES), in S205, the PC 122 may transmit a read command signal commanding the reader 5 to read the recordable sheet P to the inkjet printer 121.

The inkjet printer 121 may, after transmitting the message-display signal in S302, in S303, await until the read-command signal is received (S303: NO). When the read command signal is received (S303: YES), in S304, the inkjet printer 121 may control the reader 5 to read the test patterns 60 recorded on the recordable sheet P set in the reader 5. In S305, the inkjet printer 121 may transmit the outcome of the reading to the PC 122.

The PC 122 may, after transmitting the read command signal in S205, in S206, await until the outcome of the reading from the reader 5 is received (S206: NO). When the outcome of the reading is received (S206: YES), in S207, the PC 122 may generate adjuster signals to adjust the settings, including the amounts of conveying the recordable sheet P, ink-discharging evenness of the nozzles 10, and the discharging timings to discharge the inks from the nozzles 10, based on the outcome of the reading and may transmit the generated adjuster signals to the inkjet printer 121. Thus, the inkjet printer 121 may adjust the settings including the amounts of conveying the recordable sheet P, ink-discharging evenness of the nozzles 10, and the discharging timings to discharge the inks from the nozzles 10 based on the outcome of the reading.

In the third modified example, the recorded test patterns may be read by the reader 5; however, the outcome of the recording may not necessarily be input through the reader 5. For example, the user may visually observe the recorded test patterns and enter the adjuster signals through the operation interface 7 based on the observation to adjust the settings by the entered adjuster signals.

In the embodiment described above, the recordable sheet P may move with respect to the inkjet head 12 by being moved in the conveying direction by the conveyer roller 13 and the ejection roller 16; however, the recordable sheet P not necessarily be moved in the conveying direction by the conveyer roller 13 and the ejection roller 16 to move relatively to the inkjet head 12. In other words, the guide rails to support the carriage 11 may be movable in the conveying direction along with the carriage 11, and by moving the guide rails in the conveying direction, the inkjet head 12 and the recordable sheet P may move relatively to each other in the conveying direction. Thus, the guide rail may cause the relative movement between the inkjet head 12 and the recordable sheet P, and the conveying action may include moving the guide rails with the inkjet head 12 relatively to the recordable sheet P.

For another example, the present disclosure may not necessarily be applied to the inkjet printer being a serial printer, which may discharge the inks from the inkjet head 12 while the inkjet head 12 on the carriage 11 moves in the scanning direction, but may be applied to a line printer having a linear inkjet head, which extends linearly throughout an entire widthwise range in a widthwise direction intersecting with the conveying direction.

For another example, the present disclosure may not necessarily be applied to a printer that may record the test patterns on the recordable sheet P in the inks discharged from the inkjet head through the nozzles. In other words, the present disclosure may be applied to a printer that may record an image on a recordable medium other than the recordable sheet, such as, for example, fabric such as T-shirts, sheets for outdoor billboards, cases or shells for mobile terminals such as smartphones, cardboards, resin members, and so on. For another example, the liquid to be discharged from the discharging head through the nozzles may not necessarily be limited to the inks. In other words, the present disclosure may be applied to a liquid discharging apparatus, a liquid discharging system, a pattern recording method to record test patterns by the liquid discharging apparatus, and a computer-readable medium to store computer-readable instructions to control a computer in the liquid discharging apparatus, while the liquid to be discharged may be any other liquid than inks.

What is claimed is:

1. A liquid discharging apparatus, comprising:

a liquid discharging head comprising a plurality of nozzles arrayed in an arrayed direction, the liquid discharging head being configured to perform a discharging action to discharge liquid from at least a part of the plurality of nozzles;

a relatively-movable device configured to perform a relative moving action to move the liquid discharging head and a liquid-discharge objective medium relatively in the arrayed direction; and a controller configured to control the liquid discharging head and the relatively-movable device to record a relative movement adjuster pattern, the relative movement adjuster pattern having a first pattern piece and a second pattern piece, and a different pattern, the different pattern having a plurality of different-pattern pieces, the relative movement adjuster pattern and the different pattern being arranged side by side along a direction orthogonal to the arrayed direction on a same liquid-discharge objective medium, the controller being configured to control the liquid discharging head and the relatively-movable device to record:

the relative movement adjuster pattern by:

controlling the liquid discharging head to perform the discharging action to record the first pattern piece;

after the discharging action to record the first pattern piece, controlling the relatively-movable device to perform the relative moving action to move the liquid discharging head and the liquid-discharge objective medium relatively by a predetermined relative moving amount at least once; and after the relative moving action by the predetermined relative moving amount, controlling the liquid discharging head to perform the discharging action to record the second pattern piece, and the different pattern by:

controlling the liquid discharging head to perform the discharging action for a plurality of times and controlling the relatively-movable device to perform the relative moving action to move the liquid discharging head and the liquid-discharge objective medium relatively by a moving amount different from the predetermined relative moving amount at least once, wherein the relative movement adjuster pattern includes a plurality of relative movement adjuster patterns arranged at different positions in the arrayed direction, the plurality of relative movement adjuster patterns being recorded on the same liquid-discharge objective medium as the different pattern side by side along the direction orthogonal to the arrayed direction by the controller controlling the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

2. The liquid discharging apparatus according to claim 1, wherein the relatively-movable device comprises a conveyer configured to convey the liquid-discharge objective medium in the arrayed direction to move the liquid discharging head and the liquid-discharge objective medium relatively.

3. The liquid discharging apparatus according to claim 1, further comprising a signal receiver configured to receive an adjuster signal corresponding to recorded outcomes of the relative movement adjuster pattern and the different pattern, wherein, in response to receiving of the adjuster signal in the signal receiver, based on the received adjuster signal, the controller is configured to adjust a relative moving amount between the liquid discharging head and the liquid-discharge objective medium to be moved by the relatively-movable device and an adjustable setting related to the different pattern other than the relative moving amount.

4. The liquid discharging apparatus according to claim 1, wherein the different pattern includes a first different pattern and a second different pattern, a moving amount in the relative moving action for recording the second different pattern being different from a moving amount in the relative moving action for recording the first different pattern, and wherein, for recording the plurality of relative movement adjuster patterns, in which a distance in the arrayed direction between a first relative movement adjuster pattern being one of the at least one of the plurality of relative movement adjuster patterns and the next one of the plurality of relative movement adjuster patterns to be recorded next to the first relative movement adjuster pattern and a distance in the arrayed direction between a second relative movement adjuster pattern being another one of the at least one of the plurality of relative movement adjuster patterns and the next one of the plurality of relative movement adjuster patterns to be recorded next to the second relative movement adjuster pattern are different, the controller is configured to:

after recording the first relative movement adjuster pattern, and before recording the next one of the plurality of relative movement adjuster patterns to be recorded next to the first relative movement adjuster pattern, control the relatively-movable device to perform the relative moving action by the moving amount for recording the first different pattern at least once; and after recording the second relative movement adjuster pattern, and before recording the next one of the plurality of relative movement adjuster patterns to be recorded next to the second relative movement adjuster pattern, control the relatively-movable device to perform the relative moving action by the moving amount for recording the second different pattern at least once.

5. The liquid discharging apparatus according to claim 3, wherein the predetermined relative moving amount is a multiple of the relative moving amount in the relative moving action for recording the different pattern by a predetermined integer, wherein the plurality of different-pattern pieces include first different-pattern pieces and second different-pattern pieces, and wherein the controller is configured to control the liquid discharging head and the relatively-movable device to record the different pattern by:

controlling the liquid discharging head to record the first different-pattern pieces along with the first pattern piece for the relative movement adjuster pattern in a specific discharging action;

after the specific discharging action, controlling the relatively-movable device to perform the relative moving action for a number of times equal to the predetermined integer; and in a next discharging action after the relative moving action performed for the number of times equal to the predetermined integer, controlling the liquid discharging head to record the second different-pattern pieces along with the second pattern piece for the relative movement adjuster pattern.

6. The liquid discharging apparatus according to claim 5, further comprising:

a carriage, on which the liquid discharging head is mounted, the carriage being configured to move in a scanning direction orthogonal to the arrayed direction; and a corrugating member configured to deform the liquid-discharge objective medium into a corrugated form along the scanning direction, wherein the different pattern includes a timing adjuster pattern, wherein, for recording the timing adjuster pattern, the controller is configured to:

control the carriage to reciprocate for a plurality of times in the scanning direction;

control the liquid discharging head to perform the discharging action each time the carriage moves in one way and in the other way to reciprocate in the scanning direction; and control the relatively-movable device to perform the relative moving action each time the carriage reciprocates, and wherein the controller is configured to control discharging timings, in which the liquid is discharged at the liquid-discharge objective medium from the at least a part of the plurality of nozzles in the discharging actions, such that relativity between the discharging timings in the discharging action performed when the carriage moves in the one way and the discharging timings in the discharging action performed when the carriage move in the other way to be different each time the carriage reciprocates.

7. The liquid discharging apparatus according to claim 1, wherein the controller is configured to, for the relative moving action to be performed after recording the first pattern piece and before the discharging action to record the second pattern piece for recording the relative movement adjuster pattern, control the relatively-movable device to perform a predetermined relative moving action, in which the liquid discharging head and the liquid-discharge objective medium are moved relatively by the predetermined relative moving amount.

8. The liquid discharging apparatus according to claim 7, wherein, for recording the different pattern, the controller is configured to, for the relative moving action to move the liquid discharging head and the liquid-discharge objective medium relatively by the moving amount different from the predetermined relative moving amount, control the relatively-movable device to perform a greater-amount relative moving action, in which the liquid discharging head and the liquid-discharge objective medium are moved relatively by a greater moving amount greater than the predetermined relative moving amount, at least once, wherein the controller is configured to, in a specific greater-amount relative moving action being one of the greater-amount relative moving action to be performed at least once, control the relatively-movable device to perform divided relative moving actions to move the liquid discharging head and the liquid-discharge objective medium relatively by the greater moving amount, the divided relative moving actions including performing the predetermined relative moving action at least once and performing the relative moving action to move the liquid discharging head and the liquid-discharge objective medium relatively by a relative moving amount smaller than the greater moving amount, and wherein the controller is configured to control the liquid discharging head to perform the discharging action to record the first pattern piece, the predetermined relative moving action at least once, and the discharging action to record the second pattern piece continuously.

9. The liquid discharging apparatus according to claim 7, wherein the relatively-movable device is configured to move the liquid discharging head and the liquid-discharge objective medium relatively to move the liquid-discharge objective medium with respect to the liquid discharging head toward one side in the arrayed direction, wherein the different pattern includes an evenness adjuster pattern having a first plain part, a second plain part arranged continuously with the first plain part in the arrayed direction, and a third plain part arranged continuously with the second plain part in the arrayed direction, wherein the controller is configured to control the liquid discharging head and the relatively-movable device to record the different pattern by controlling the liquid discharging head and the relatively-movable device to perform a unit color-filling action for a plurality of times, for the unit color-filling action the controller being configured to:

control the liquid discharging head to perform the discharging action to discharge the liquid from a part of the plurality of nozzles arranged at positions toward the one side in the arrayed direction to record the first plain part;

after recording the first plain part, control the relatively-movable device to perform a smaller-amount relative moving action, in which the liquid discharging head and the liquid-discharge objective medium are moved relatively by a smaller moving amount smaller than the predetermined relative moving amount, and after the smaller-amount relative moving action, control the liquid discharging head to perform the discharging action to discharge the liquid from all of the plurality of nozzles to record the second plain part; and after recording the second plain part, control the relatively-movable device to perform the smaller-amount relative moving action, and after the smaller-amount relative moving action, control the liquid discharging head to perform the discharging action to discharge the liquid from another part of the plurality of nozzles arranged at positions toward the other side in the arrayed direction to record the third plain part.

10. A liquid discharging system, comprising:

a liquid discharging apparatus, comprising:

a liquid discharging head having a plurality of nozzles arrayed in an arrayed direction, the liquid discharging head being configured to perform a discharging action to discharge liquid from at least a part of the plurality of nozzles; and a relatively-movable device configured to perform a relative moving action to move the liquid discharging head and a liquid-discharge objective medium relatively in the arrayed direction;

a controller connected with the liquid discharging apparatus, the controller being configured to:

control the liquid discharging head and the relatively-movable device to record a relative movement adjuster pattern, the relative movement adjuster pattern having a first pattern piece and a second pattern piece, and a different pattern, the different pattern having a plurality of different-pattern pieces, the relative movement adjuster pattern and the different pattern being arranged side by side along a direction orthogonal to the arrayed direction on a same liquid-discharge objective medium, the controller being configured to control the liquid discharging head and the relatively-movable device to record:

the relative movement adjuster pattern by:

controlling the liquid discharging head to perform the discharging action to record the first pattern piece;

after the discharging action to record the first pattern piece, controlling the relatively-movable device to perform the relative moving action to move the liquid discharging head and the liquid-discharge objective medium relatively by a predetermined relative moving amount at least once; and after the relative moving action by the predetermined relative moving amount, controlling the liquid discharging head to perform the discharging action to record the second pattern piece, and the different pattern by:

controlling the liquid discharging head to perform the discharging action for a plurality of times and controlling the relatively-movable device to perform the relative moving action to move the liquid discharging head and the liquid-discharge objective medium relatively by a moving amount different from the predetermined relative moving amount at least once, wherein the relative movement adjuster pattern includes a plurality of relative movement adjuster patterns arranged at different positions in the arrayed direction, the plurality of relative movement adjuster patterns being recorded on the same liquid-discharge objective medium as the different pattern side by side along the direction orthogonal to the arrayed direction by the controller controlling the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

11. A pattern recording method for a liquid discharging apparatus to record patterns in liquid on a liquid-discharge objective medium, the liquid discharging apparatus comprising:

a liquid discharging head including a plurality of nozzles arrayed in an arrayed direction, the liquid discharging head being configured to perform a discharging action to discharge liquid from at least a part of the plurality of nozzles; and a relatively-movable device configured to perform a relative moving action to move the liquid discharging head and the liquid-discharge objective medium relatively in the arrayed direction, the method comprising controlling the liquid discharging head and the relatively-movable device to record a relative movement adjuster pattern, the relative movement adjuster pattern having a first pattern piece and a second pattern piece, and a different pattern, the different pattern having a plurality of different-pattern pieces, the relative movement adjuster pattern and the different pattern being arranged side by side along a direction orthogonal to the arrayed direction on a same liquid-discharge objective medium, the liquid discharging head and the relatively-movable device being controlled to record:

the relative movement adjuster pattern by:

performing the discharging action to record the first pattern piece;

after the discharging action to record the first pattern piece, performing the relative moving action to move the liquid discharging head and the liquid-discharge objective medium relatively by a predetermined relative moving amount at least once; and after the relative moving action, performing the discharging action to record the second pattern piece, and the different pattern by:

performing the discharging action for a plurality of times and performing the relative moving action to move the liquid discharging head and the liquid-discharge objective medium relatively by a moving amount different from the predetermined relative moving amount at least once, wherein the relative movement adjuster pattern includes a plurality of relative movement adjuster patterns arranged at different positions in the arrayed direction, and wherein the method further comprises, for recording the plurality of relative movement adjuster patterns on the same liquid-discharge objective medium as the different pattern side by side along the direction orthogonal to the arrayed direction, controlling the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

12. A non-transitory computer readable storage medium storing computer readable instructions that are executable by a computer configured to control a liquid discharging apparatus, the liquid discharging apparatus comprising:

a liquid discharging head including a plurality of nozzles arrayed in an arrayed direction, the liquid discharging head being configured to perform a discharging action to discharge liquid from at least a part of the plurality of nozzles; and a relatively-movable device configured to perform a relative moving action to move the liquid discharging head and the liquid-discharge objective medium relatively in the arrayed direction, the computer readable instructions, when executed by the computer, causing the computer to control the liquid discharging head and the relatively-movable device to record a relative movement adjuster pattern, the relative movement adjuster pattern having a first pattern piece and a second pattern piece, and a different pattern, the different pattern having a plurality of different-pattern pieces, the relative movement adjuster pattern and the different pattern being arranged side by side along a direction orthogonal to the arrayed direction on a same liquid-discharge objective medium, the computer readable instructions causing the computer to control the liquid discharging head and the relatively-movable device to record:

the relative movement adjuster pattern by:

controlling the liquid discharging head to perform the discharging action to record the first pattern piece;

after the discharging action to record the first pattern piece, controlling the relatively-movable device to perform the relative moving action to move the liquid discharging head and the liquid-discharge objective medium relatively by a predetermined relative moving amount at least once; and after the relative moving action by the predetermined relative moving amount, controlling the liquid discharging head to perform the discharging action to record the second pattern piece, and the different pattern by:

controlling the liquid discharging head to perform the discharging action for a plurality of times and controlling the relatively-movable device to perform the relative moving action to move the liquid discharging head and the liquid-discharge objective medium relatively by a moving amount different from the predetermined relative moving amount at least once, wherein the relative movement adjuster pattern includes a plurality of relative movement adjuster patterns arranged at different positions in the arrayed direction, and wherein the computer readable instructions, when executed by the computer, for recording the plurality of relative movement adjuster patterns on the same liquid-discharge objective medium as the different pattern side by side along the direction orthogonal to the arrayed direction, cause the computer to control the relatively-movable device, after recording at least one of the plurality of relative movement adjuster patterns, and before recording a next one of the plurality of relative movement adjuster patterns next to the at least one of the plurality of relative movement adjuster patterns, to perform the relative moving action by the moving amount different from the predetermined relative moving amount for recording the different pattern at least once.

* * * * *